US007422996B2

(12) United States Patent
Shimbo et al.

(10) Patent No.: US 7,422,996 B2
(45) **Date of Patent: *Sep. 9, 2008**

(54) REVERSIBLE THERMOSENSITIVE RECORDING MEDIUM, REVERSIBLE THERMOSENSITIVE RECORDING LABEL, REVERSIBLE THERMOSENSITIVE RECORDING MEMBER, IMAGE-PROCESSING APPARATUS AND IMAGE-PROCESSING METHOD

(75) Inventors: Hitoshi Shimbo, Shizuoka (JP); Kunio Hayakawa, Mishima (JP); Shinya Kawahara, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/724,653

(22) Filed: Mar. 15, 2007

(65) Prior Publication Data

US 2007/0219093 A1 Sep. 20, 2007

(30) Foreign Application Priority Data

Mar. 15, 2006 (JP) ..... 2006-070838

(51) Int. Cl.
*B41M 5/42* (2006.01)

(52) U.S. Cl. ..... 503/201; 346/135.1; 503/207; 503/216; 503/226

(58) Field of Classification Search ..... None
See application file for complete search history.

(56) References Cited

U.S. PATENT DOCUMENTS

| | | | |
|---|---|---|---|
| 5,395,815 | A | 3/1995 | Ikeda et al. |
| 6,071,851 | A | 6/2000 | Wakamatsu |
| 2005/0014645 | A1 | 1/2005 | Shimbo et al. |
| 2005/0137088 | A1 | 6/2005 | Hayakawa et al. |
| 2005/0197250 | A1 | 9/2005 | Kawahara et al. |

FOREIGN PATENT DOCUMENTS

| | | |
|---|---|---|
| EP | 0574879 A1 | 12/1993 |
| JP | 5-124346 | 5/1993 |
| JP | 6-199041 | 7/1994 |
| JP | 7-164648 | 6/1995 |

(Continued)

OTHER PUBLICATIONS

European search report in connection with corresponding European patent application No. EP 07 10 4158.

*Primary Examiner*—Bruce H Hess
(74) *Attorney, Agent, or Firm*—Cooper & Dunham, LLP

(57) ABSTRACT

There is provided a reversible thermosensitive recording medium including a support, an intermediate layer, and a thermosensitive recording layer which reversibly changes a color thereof depending on a temperature, wherein the thermosensitive recording layer contains an electron-donating coloring compound, and an electron-accepting compound represented by the following general formula 1:

General formula 1 where, n is an integer of 23 or more, and wherein the intermediate layer is disposed between the support and the thermosensitive recording layer, and contains hollow particles having a void ratio of 70% or more, a maximum diameter D100 of 5.0 μm to 10.0 μm, and a ratio D100/D50 of 2.0 to 3.0 where the ratio D100/D50 is a ratio of the maximum diameter D100 to a 50% cumulative particle diameter D50 of the hollow particles.

13 Claims, 3 Drawing Sheets

FOREIGN PATENT DOCUMENTS

| | | |
|---|---|---|
| JP | 8-45038 | 2/1996 |
| JP | 9-267568 | 10/1997 |
| JP | 11-240251 | 9/1999 |
| JP | 2981558 | 9/1999 |
| JP | 2000-25336 | 1/2000 |
| JP | 2002-166649 | 6/2002 |
| JP | 3380277 | 12/2002 |
| JP | 3557076 | 5/2004 |
| JP | 2005-53124 | 3/2005 |

REVERSIBLE THERMOSENSITIVE RECORDING MEDIUM, REVERSIBLE THERMOSENSITIVE RECORDING LABEL, REVERSIBLE THERMOSENSITIVE RECORDING MEMBER, IMAGE-PROCESSING APPARATUS AND IMAGE-PROCESSING METHOD

BACKGROUND OF THE INVENTION

1. Field of the Invention

The present invention relates to a reversible thermosensitive recording medium in which color images are formed and erased reversibly based on color-developing reactions between an electron-donating coloring compound and an electron-accepting compound by controlling applied thermal energies, and also relates to a reversible thermosensitive recording label, a reversible thermosensitive recording member, an image-processing apparatus and a method which employ the reversible thermosensitive recording medium respectively.

2. Description of the Related Art

Thermosensitive recording media which utilize reactions between an electron-donating coloring compound (hereinafter, sometimes referred as "coloring agent" or "leuco dye") and an electron-accepting compound (hereinafter, sometimes referred as "color developer") have been well-known, and have been broadly utilized as output papers of facsimiles, word processors and scientific instrumentation apparatuses, with an advance of office automation, and nowadays in magnetic thermosensitive cards such as a pre-paid card and point card. However, there is still the need for the development of reversible thermosensitive recording media which are repeatedly rewritable in view of an environmental issue and a recycling of the resource.

As such the reversible thermosensitive recording media, there has been proposed a reversible thermosensitive recording medium which, by combining a color developer of an organic phosphoric acid compound, aliphatic carbonic acid compound or phenol compound containing a long chain aliphatic hydrocarbon group, and a coloring agent of leuco dye, easily realizes coloring and decoloring by controlling heating and cooling conditions, is enables to stably maintain the coloring state and the decoloring state at room temperature, and is able to repeatedly perform coloring and decoloring (see Japanese Patent (JP-B) No. 2981558). After this technique was proposed, there was proposed a specific molecular structure of the phenol compound having a long chain aliphatic hydrocarbon group (see JP-B Nos. 3380277, and 3557076). Among the compounds having these proposed structures, it has been known that a urea derivative having a phenol group and a long chain alkyl group shows particularly excellent erasing ability.

When a thermosensitive recording medium using such the urea derivative as a color developer is repeatedly rewritten by a printer, there are however defects such that an amount of dusts adhered to a heat source, e.g. a thermal head or a ceramic heater, tends to be increased, and a density of color image is therefore decreased due to the deposition of the dusts. Since an applied energy from the heat source is increased as a transfer speed of the printer is increased, the adhesion of the dusts is prone to be increased. As a result, print failures, i.e. lower density, friction mark, white out and the like, are caused, and such the print failures become a large problem when realizing a high speed printer.

As a method for preventing dusts adhesions to a heat source such as a thermal head, there has been proposed a method wherein a protective layer containing a electron beam curing resin and filler is arranged in a thermosensitive recording medium (see Japanese Patent Application Laid-Open (JP-A) Nos. 2000-25336, and 11-240251). According to this method, the protective layer however becomes a barrier for transferring a heat from a thermal head to a thermosensitive recording layer, and thus coloring and decoloring sensitivity is lowered. This problem becomes significant especially when a transfer speed of a printer is set at high speed. In addition, there have been proposed a method wherein a silicone resin is added to a protective layer (see JP-A No. 2005-53124), a method wherein a surface roughness of a protective layer is controlled at a certain condition (see JP-A No. 2002-166649), and a method wherein a barrier layer containing an organic substance is disposed (see JP-A No. 09-267568). In these methods, there is also a problem that the coloring and decoloring sensitivity is lowered. Therefore, these methods are also not yet effective.

JP-A Nos. 08-45038 and 07-164648 propose a method for removing dusts on a thermal head by using a cleaning member. JP-A No. 06-199041 proposes a method in which a liquid is applied on a thermal head. However, these proposed methods need to be performed additionally apart from a coloring and decoloring process of a reversible thermosensitive recording medium, and thus they require more processes and the productivity is lowered.

JP-A No. 05-124346 proposes a method in which an undercoat layer is disposed in a reversible thermosensitive recording medium, and as the undercoat layer, it uses a cushion member formed by coating polyurethane foam or foamable plastic filler, and heating for foaming. However, this method requires an operation of heating for foaming after applying the foamable plastic filler. Therefore, the operation in the production process becomes complicated, and the particle size distribution of the foamed particles becomes broad after heating. As a result, there are problems such that a surface smoothness is decreased due to coarse foamed particles, and cushioning properties are lowered since some particles are remained without being completely formed.

JP-B No. 3565564 proposes to dispose an undercoat layer containing thermosensitive gelling latex and fine hollow particles. In this method, it is very difficult to control the conditions for applying the thermosensitive gelling agent, and thus this method is not suitable for the mass production.

Accordingly, there is still a need for providing a reversible thermosensitive recording material which decreases an amount of dusts adhesion to a heat source such as a thermal head, and has excellent erasing ability in high transfer speed.

BRIEF SUMMARY OF THE INVENTION

An object of the present invention is to provide a reversible thermosensitive recording medium that inhibits dusts adhesion to a heat source, e.g. a thermal head, and exhibits an excellent erasing ability at high conveying speed. Another object of the present invention is to provide a reversible thermosensitive recording label, a reversible thermosensitive recording member, an image-processing apparatus, and an image-processing method, using such the reversible thermosensitive recording medium.

After the diligent studies for achieving the above objects, the present inventors found that such a reversible thermosensitive recording medium that inhibits dust adhesion to a heat source such as a thermal head, and exhibits excellent erasing ability at a high conveying speed can be provided in the case where the reversible thermosensitive recording medium contains a support, an intermediate layer disposed on the support, and a thermosensitive recording layer which reversibly changes color thereof depending on a temperature, wherein the thermosensitive recording layer contains an electron-donating coloring compound, and an electron-accepting compound which is a urea derivative having a C23 or more alkyl group and a phenol group, and wherein the intermediate layer is disposed between the support and the thermosensitive recording layer, and contains hollow particles having a certain void ratio and particle distribution.

The reversible thermosensitive recording medium of the present invention contains: a support; an intermediate layer; and a thermosensitive recording layer which reversibly changes a color thereof depending on a temperature, wherein the thermosensitive recording layer contains an electron-donating coloring compound, and an electron-accepting compound represented by the following general formula 1:

General formula 1

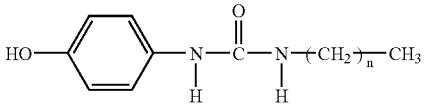

where, n is an integer of 23 or more, wherein the intermediate layer is disposed between the support and the thermosensitive recording layer, and contains hollow particles that have a void ratio of 70% or more, a maximum diameter D100 of 5.0 μm to 10.0 μm, and a ratio D100/D50 of 2.0 to 3.0, where the ratio D100/D50 is a ratio of the maximum diameter D100 to a 50% cumulative particle diameter D50 of the hollow particles.

The reversible thermosensitive recording label of the present invention contains either an adhesive layer or a sticky layer on the face of the reversible thermosensitive recording medium of the present invention, which is located opposite to the face thereof on which an image is formed.

The reversible thermosensitive recording member of the present invention contains an information-memorizing part and a reversible display part, and the reversible display part contains the reversible thermosensitive recording medium of the present invention.

The image-processing apparatus of the present invention contains the reversible thermosensitive recording medium of the present invention, and at least one of an image-forming unit and an image-erasing unit, wherein the image-forming unit is configured to heat the reversible thermosensitive recording medium so as to form an image thereon, and the image-erasing unit is configured to heat the reversible thermosensitive recording medium so as to erase the image formed thereon.

The image-processing method of the present invention contains at least one of: heating a reversible thermosensitive recording medium so as to form an image thereon; and heating the reversible thermosensitive recording medium so as to erase the image formed thereon, wherein the reversible thermosensitive recording medium is the reversible thermosensitive recording medium of the present invention.

DETAILED DESCRIPTION OF THE INVENTION (Reversible Thermosensitive Recording Medium)

The reversible thermosensitive recording medium of the present invention contains a support, an intermediate layer disposed on the support, and a thermosensitive recording layer containing an electron-donating coloring compound, i.e., a coloring agent, and an electron-accepting compound, i.e., a color developer, disposed on the intermediate layer. The reversible thermosensitive recoding medium of the invention further contains other layers, if necessary. Moreover, other layer or layers can be disposed in between the support and the intermediate layer, and in between the intermediate layer and the thermosensitive recording layer.

In the present invention, the electron-accepting compound, i.e., the color developer contains a compound represented by the following general formula 1:

General formula 1

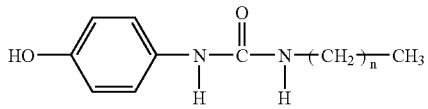

Note that, in the general formula 1, n denotes an integer of 23 or larger.

The reversible thermosensitive medium of the present invention contains the above-mentioned certain urea compound, and reversibly changes a color thereof depending on the temperature. The phrase "reversibly changes a color thereof depending on the temperature" means phenomena of reversible visual changes caused depending on the temperature, and means that a coloring state, and a decoloring state are formed corresponding to differences in heating temperatures and cooling speeds after heating. The above-mentioned visual changes are generally classified into a color change and a formation change, but the present invention utilizes a material mainly causing the color change. The color change includes changes in transparency, reflectance, absorbance wavelength, degree of dispersion, and the like. The materials for practical use in the reversible thermosensitive recording medium utilize a combination of these changes for displaying. The principal of coloring and decoloring phenomenon is described hereinafter.

Figure 1:
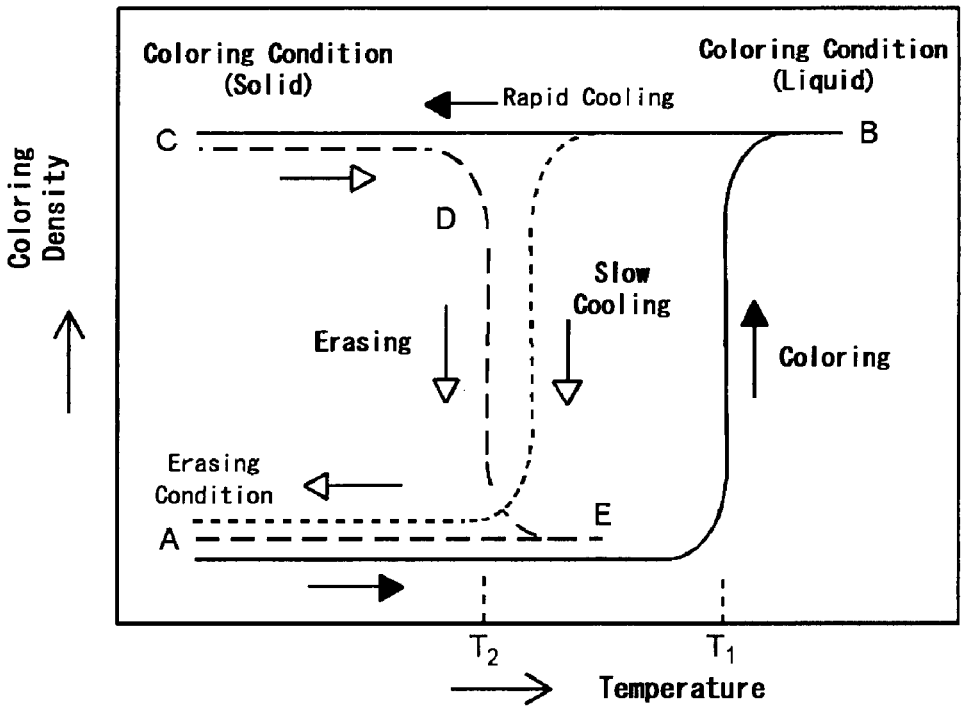
FIG. 1 is a diagram showing coloring and decoloring phenomena of a reversible thermosensitive coloring composite for use in the present invention.

FIG. 1 shows the relationship between the coloring density and temperature of the reversible thermosensitive recording medium. When the recording medium is heated from the initial decolored condition (A), a leuco dye and a color developer are melted at the temperature T1 at which the melting begins, and then the recording medium comes to the melted and developed condition (B), through an occurrence of developing. When cooled rapidly from the melted and developed condition (B), it may be cooled to the room temperature while maintaining the developed condition, thereby a fixed and developed condition (C) emerges. Whether or not the developed condition emerges depends on the cooling rate from the melted condition, and when cooled slowly, the erasing appears during a temperature decreasing process, that is, the initial erased condition (A) or lower density than rapid cooling (C) emerges. On the other hand, when heated again from rapidly cooled coloring condition (C), erasing occurs at a lower temperature T2 than the developing temperature (D to E); when cooled from this temperature, resulting in the initial erased condition (A). Actual developing and erasing temperatures may be selected depending on the application since these temperatures vary with the utilized coloring agent and color developer. Moreover, the coloring density at the melting condition and the coloring density after the rapid cooling may not necessarily coincide with each other, and are different in some cases.

In the reversible thermosensitive recording medium of the invention, the coloring condition (C) obtained through rapid cooling from the melted condition is a condition in which the coloring agent and color developer are blended such that they may react through molecular contact, and the coloring condition is often solid state. In the condition, the coloring agent and the color developer are coagulated to represent a coloring condition. It is believed that the formation of the coagulated condition makes the coloring condition stable. On the other hand, in the erased condition, the coloring agent and color developer are in phase separation. It is believed that the molecules of at least one of the compounds assemble to form domains or crystals in the separated condition, and that the coloring agent and color developer are separated and stabilized through the coagulation or crystallization. In the invention, in many cases, the phase separation of the coloring agent and the color developer and also the crystallization of the color developer cause the erasure more perfectly. In the erasure due to slower cooling from the melted condition as well as the erasure due to the heating from the coloring condition as shown in FIG. 1, the coagulated structures are altered depending on the temperatures, resulting in the phase separation and/or crystallization of the color developer.

The present inventors has considered that a crystallization speed of the color developer at the time of heating from the coloring condition (C) to the decoloring temperature is curtail for performing erasure within very short heating time, for example heating by means of a thermal head. As a result of diverse studies, the present inventors found that the urea compound represented by the above-shown general formula 1 has an excellent erasure performance.

The basic molecular structure of the compound represented by the general formula 1 has already been disclosed in Japanese Patent No. 3380277. This patent publication discloses that larger n is more preferable, but n of 22 or more is not preferable in view of production cost thereof. The publication specifically discloses a phenol urea compound having n of less than 22.

On the other hand, the compound represented by the general formula 1 of the present invention has n of 23 or more, preferably 27 or more, and more preferably in the range of 27 to 32. In the case where n is less than 23, maintainability of colored images may be degraded. In the case where n is more than 32, the synthesis of the compound represented by the general formula becomes considerably difficult due to physical properties of the intermediate product and synthesis reaction product thereof.

The compound represented by the general formula 1 can be synthesized in accordance with a synthesis method disclosed in Japanese Patent No. 3380277. Specifically, alkyl isocianate having the predetermined length of a carbon chain is added into a solution which is prepared by dissolving amino phenol in methyl ethyl ketone, and the mixed solution is heated and stirred for a few hours to thereby synthesize the compound represented by the general formula 1.

The compound represented by the general formula 1 has low viscosity and high flowability when heated and fused. Therefore, it has drawbacks such that at the time of printing by means of a thermal head, a fused product thereof is prone to attach to the thermal head. If the reversible thermosensitive recording medium using such the compound continuously receives heat from the thermal head in the above-mentioned condition, the attachments to the thermal head become powders, and soil the thermal head. This lowers an image density, and causes white line which is colorless line formed at a part of the formed image. Therefore, the practicality of the reversible thermosensitive recording medium is decreased.

As a result of the further diligent studies for solving the above-mentioned problems, the present inventors found that: (1) attachments to a heat source such as a thermal head are prevented from fusing to the heat source by lowering applying energy from the heat source such as a thermal head, a ceramic heater, and the like, necessary for attaining the same image density obtainable with the conventional energy level; and (2) powders or dusts are unlikely to attach to the heat source such as a thermal head by improving the adhesion between the reversible thermosensitive recording medium and the heat source such as a thermal head. Based upon these findings, it was found that the effective solution is to dispose an intermediate layer containing hollow particles having certain void ratio and particle distribution, between the support and the thermosensitive recording layer.

It has been conventionally proposed to disposed an intermediate layer in which foaming plastic particles are contained and heated to yield foams, between a support and a thermosensitive recording layer, for example in JP-A No. 05-124346. In accordance with the techniques disclosed in JP-A No. 05-124346, the foamed particle diameter after heating for forming however is largely varied, and thus a surface of the reversible thermosensitive recording layer has considerable roughness. This surface roughness lowers an adhesion to the heat source. Moreover, there is also a problem such that the lowering amount of the applying energy from the heat source is reduced since there remain unfoamed particles that reduce air volume effective for heat insulation in the intermediate layer to thereby lower heat insulating property.

The present invention utilizes hollow particles which have been previously subjected to a foaming process, and the hollow particles for use in the present invention have a sharp particle distribution such that the maximum particle diameter D100 is 5.0 μm to 10.0 μm, and a ratio D100/D50 of the maximum particle diameter D100 to the 50% cumulative particle diameter D50 is 2.0 to 3.0. In this manner, the surface smoothness is improved, and large air volume can be captured and maintained in the intermediate layer. Therefore, it is possible to attain high heat insulating property as well as achieving high adhesion to the heat source. As a result, adhesion and fusion of powders or dusts to the heat source such as a thermal head can be largely reduced while maintaining excellent erasing ability which is characteristics of the case where the certain compound represented by the general formula 1 is used in the reversible thermosensitive recording medium.

It is preferred in the present invention that the maximum particle diameter of hollow particles is from 5 μm to 10 μm, preferably 6 μm to 9 μm. In the case where the maximum particle diameter is more than 10 μm, the surface roughness of the reversible thermosensitive recording medium becomes significant, and thus white-out is prone to be formed when a solid image is printed. In the case where the maximum particle diameter is less than 5 μm, it is difficult for the hollow particles to attain viod ratio of 70% or more, and thus the thermal sensitivity is lowered. Considering only an improvement of color density, the effect can be attained when the void ratio or 60% or more. However, the image formation system for the reversible thermosensitive recording medium has an image erasing process. In addition, when an image is erased by a thermal head, the amount of energy used for erasing the image is extremely small compared with that required when erased by a heat roller. Thus, it is necessary to utilize that energy applied more efficiently in a thermal head method. Consequently, to secure an erasure image density and an enlargement of the erasable energy range width for a thermal head method, the hollow particles for use in the intermediate layer are necessary to have the void ratio of not less than 70%, preferably 80% or more.

It is preferred in the present invention that the ratio (D100/D50) of the maximum particle diameter of hollow particles to the 50% cumulative particle diameter (D50) is 2.0 to 3.0, preferably 2.2 to 2.9. When the ratio (D100/D50) is more than 3.0, the particle size distribution is broad, meaning that the ratio of fine particles having a particle diameter not greater than 1 μm is large. In this case, such hollow particles are not uniformly present in the intermediate layer containing the hollow particles, resulting in deterioration of the sensitivity. When the ratio (D100/D50) is less than 2.0, the particle size distribution thereof is extremely sharp. Such hollow particles are difficult to manufacture in terms of conditions for the synthesis.

It is preferred in the present invention that the ratio of hollow particles having a diameter of 2 μm or less is from 5% to 10%, preferably 6% to 9%. In the case where the ratio is more than 10%, the ratio of fine hollow particles having a particle diameter of 1 μm or less is large. Such hollow particles are not uniformly present in the intermediate layer containing the hollow particles, resulting in deterioration of colorization sensitivity. In the case where the maximum particle diameter (D100) is 5.0 μm to 10.0 μm and the ratio is less than 5%, the particle size distribution thereof is extremely sharp. Such hollow particles are difficult to manufacture in terms of composition conditions.

The void ratio of the hollow particles can be obtained by measuring true specific gravity in accordance with an IPA method, and calculating based on the obtained true specific gravity, as follow:

(1) Pretreatment of Sample

A sample is dried at 60° C. for twenty-four hours as a pretreatment.

(2) Reagent

Isopropyl Alcohol (IPA: first class reagent)

(3) Measuring Method

W1: A measuring flask is precisely weighted.

W2: Approximately 0.5 g of the dried sample is loaded in the measuring flask, and the measuring flask is again weighted.

W3: Approximately 50 mg of IPA are added to the measuring flask, and the measuring flask is sufficiently shaken so as to completely remove the air present outside the hollow particles.

W3: IPA is further added until it reaches a bench mark marked on the measuring flask, and then the measuring flask is weighted.

W4: As a blank sample, a measuring flask is added with IPA until IPA reaches a bench mark marked thereon, and the measuring flask is weighted.

(4) Calculation of True Specific Gravity $$\text{True specific gravity} = \frac{(W2 - W1) \times [(W4 - W1)/100]}{(W4 - W1) - (W3 - W2)}$$

(5) Calculation of Void Ratio $$\text{Void ratio (\%)} = [1 - 1/(1.1/\text{true specific gravity})] \times 100$$

The particle diameter and particle size distribution of the hollow particles are measured by means of a laser diffraction particle size distribution measuring device (LA-900, manufactured by Horiba, Ltd.). The median particle diameter represents a 50% cumulative particle diameter and is specified as D50. The maximum particle diameter represents the maximum particle diameter in the distribution and is specified as D100.

<Thermosensitive Recording Layer>

The thermosensitive recording layer contains at least an electron-donating coloring compound, i.e. a coloring agent, and an electron-accepting compound, i.e. a color developer. The thermosensitive recording layer optionally contains a binder resin and a decoloring accelerator, and further contains other substance as required.

The present invention utilizes the compound represented by the general formula 1 as the electron-accepting compound, i.e. a color developer, and a leuco dye as the electron-donating coloring compound, i.e. a coloring agent. The leuco dye can be appropriately selected depending on the purpose without any restriction. For example, the leuco dye is preferably a dye precursor known in the art, such as a phthalide compound, an azaphthalide compound, or a fluoran compound.

Specific examples of the leuco dye include the following compounds:

2-anilino-3-methyl-6-diethylaminofluoran,
2-anilino-3-methyl-6-(di-n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-methylamino)fluoran,
2-anilino-3-methyl-6-(N-n-amyl-N-ethylamino)fluoran
2-anilino-3-methyl-6-(N-iso-amyl-N-ethylamino)fluoran,
2-anilino-3-methyl-6-(N-n-propyl-N-isopropylamino)-fluoran,
2-anilino-3-methyl-6-(N-cyclohexyl-N-methylamino)-fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trifluoromethylanilino)-3-methyl-6-diethylaminofluoran,
2-(m-trichloromethylanilino)-3-methyl-6-(N-cyclohexyl-N-methylam ino)fluoran,
2-(2,4-dimethylanilino)-3-methyl-6-diethylaminofluoran,
2-(N-ethyl-p-toluidino)-3-methyl-6-(N-ethylanilino)fluoran, 2-(N-ethyl-p-toluidino)-3-methyl-6-(N-propyl-p-toluidino) fluoran,
2-anilino-6-(N-n-hexyl-N-ethylamino)fluoran,
2-xylidino-3-methyl-6-dibutylaminofluoran,
2-(o-chloroanilino)-6-diethylaminofluoran,
2-(o-chloroanilino)-6-dibutylaminofluoran,
2-(m-trifluoromethylanilino)-6-diethylaminofluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
3-diethylamino-6-(m-trifluoromethylanilino)fluoran,
3-(1-ethyl-2-methylindole-3-yl)-3-(2-ethoxy-4-diethylaminophenyl)-4-azaphthalide,
3-(1-ethyl-2-methylindole-3-yl)-3-(2-ethoxy-4-diethylaminophenyl)-7-azaphthalide,
3-(1-octyl-2-methylindole-3-yl)-3-(2-ethoxy-4-diethylaminophenyl)-4-azaphthalide,
3-(1-ethyl-2-methylindole-3-yl)-3-(2-methyl-4-diethylaminophenyl)-4-azaphthalide,
3-(1-ethyl-2-methylindole-3-yl)-3-(2-methyl-4-diethylaminophenyl)-7-azaphthalide,
3-(1-ethyl-2-methylindole-3-yl)-3-(4-diethylaminophenyl)-4-azaphth alide,
3-(1-ethyl-2-methylindole-3-yl)-3-(4-N-n-amyl-N-methylaminophenyl)-4-azaphthalide,
3-(1-methyl-2-methylindole-3-yl)-3-(2-hexyloxy-4-diethylaminophenyl)-4-azaphthalide,
3,3-bis(2-ethoxy-4-diethylaminophenyl)-4-azaphthalide, and
3,3-bis(2-ethoxy-4-diethylaminophenyl)-7-azaphthalide.

Among these, 2-anilino-3-methyl-6-diethylaminofluoran, 2-anilino-3-methyl-6-di(n-butylamino)fluoran, 2-(3-tluidino)-3-methyl-6-diethylaminofluoran, 2-xylidino-3-methyl-6-dibutylaminofluoran and the like are particularly preferred since they can realize a printed image which has excellent coloring density, excellent erasing ability, excellent storage stability of the image section, a coloring tone of pure black, and vividness.

Appropriate range of the blending ratio of the electron-donating coloring compound, i.e. a coloring agent and the electron-accepting compound, i.e. a color developer, varies depending on the combinations of the compounds for use. Preferably, the mol ratio of the color developer to the coloring agent is 0.1 to 20, more preferably 0.2 to 10. The color developer amount of over or under this range may result in a lower coloring density. Moreover, the coloring agent and the color developer can be used in the form of microcapsules in which the coloring agent and the color developer are encapsulated.

—Decoloring Accelerator—

In the present invention, the color developer can be used together with a compound having at least one group selected from an amido group, urethane group, and urea group in its molecular structure as a decoloring accelerator. By using the color developer in combination with the decoloring accelerator, interactions between molecules of the decoloring accelerator and the color developer are induced in the process of forming the erasing state, and thus the speed of erasure can be extremely shortened.

The decoloring accelerator is preferably a compound having an amide group (—NHCO—), a secondary amide group (═NCO—), urethane group (—NHCOO—), a urea group (—NHCONH—), a ketone group (—CO—), a diacylhydrazide group (—CONHNHCO—), a sulfone group (—$SO_2$—), or the like in its molecular structure. Among these, a compound having an amide group, a secondary amide group, and/or a urethane group is particularly preferable. Specific examples of the compounds having an amide group and/or urethane group are compounds represented by the following general formulae 2-9.

General Formula 2

$$R^1—NHCO—R^2$$

General Formula 3

$$R^1—NHCO—R^3—CONH—R^2$$

General Formula 4

$$R^1—CONH—R^3—NHCO—R^2$$

General Formula 5

$$R^1—NHCOO—R^2$$

General Formula 6

$$R^1—NHCOO—R^3—OCONH—R^2$$

General Formula 7

$$R^1—OCONH—R^3—NHCOOVR^2$$

General formula 8

$$R^1—NHCOO—\underset{\underset{OCONH—R^4}{|}}{R^5}—OCONH—R^2$$

General formula 9

$$R^1—(Y—R^3)_s—\overset{\overset{O}{\|}}{C}—N\begin{matrix}R^6\\R^7\end{matrix}$$

In the general formulae 2-9, $R^1$, $R^2$, $R^4$, $R^6$, and $R^7$ denote a linear C1-22 alkyl group, a branched C1-22 alkyl group, or an unsaturated C1-22 alkyl group, and $R^6$ and $R^7$ may form a ring. The ring may be formed via a nitrogen atom, an oxygen atom, or a sulfur atom, and may contain an aromatic ring, or aliphatic ring. The alkyl group may have a substituent of a hydroxyl group, a halogen atom, an alkoxy group, or the like. $R^3$ denotes a bivalent C1-18 functional group, and $R^5$ denotes a trivalent C4-18 functional group. Y denotes a bivalent group containing a nitrogen atom or an oxygen atom, for example an amide group, a urethane group, a urea group, a ketone group, a diacylhydrozide group, or the like. S denotes an integer of 0 or 1.

Examples of $R^1$, $R^2$, $R^4$, $R^6$, and $R^7$ include a hexyl group, a heptyl group, an octyl group, a nonyl group, a decyl group, an undecyl group, a dodecyl group, a stearyl group, a behenyl group, an oleyl group, and a C1-10 hydroxyalkyl group having a hydroxyl group at the terminal thereof.

Examples of $R^6$ and $R^7$ include a methyl group, an ethyl group, a benzyl group, a phenylethyl group, a cyclohexylmethyl group, and a hydroxyethyl group. In the case where $R^6$ and $R^7$ form a ring, examples of $R^6$ and $R^7$ are a buthylene group, a pentamethylene group, a hexythamethylene group, a group represented by —$C_2H_4OC_2H_4$—, a group represented by —$C_2H_4NC_2H_4$—, a group represented by —$C_2H_4OC_2H_4OC_2H_4$—, and the like.

Examples of $R^3$ include a methylene group, an ethylene group, a propylene group, a butylene group, a pentamethylene group, a hexythamethylene group, a hepthamethylene group, an octhamethylene group, a group represented by —$C_3H_6OC_3H_6$—, a group represented by —$C_2H_4OC_2H_4$—, and a group represented by —$C_2H_4OC_2H_4OC_2H_4$—.

Examples of $R^5$ include groups represented by the following formulae:

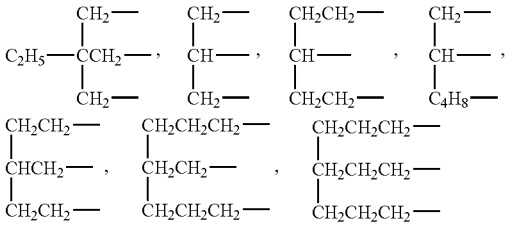

Specific examples of the compounds represented by the general formulae 2-9 are the compounds represented by the following (1) to (69):

(1) $C_{11}H_{23}CONHC_{12}H_{25}$
(2) $C_{15}H_{31}CONHC_{16}H_{33}$
(3) $C_{17}H_{35}CONHC_{18}H_{37}$
(4) $C_{17}H_{35}CONHC_{18}H_{35}$
(5) $C_{21}H_{41}CONHC_{18}H_{37}$
(6) $C_{15}H_{31}CONHC_{18}H_{37}$
(7) $C_{17}H_{35}CONHCH_2NHCOC_{17}H_{35}$
(8) $C_{11}H_{23}CONHCH_2NHCOC11H_{23}$
(9) $C_7H_{15}CONHC_2H_4NHCOC_{17}H_{35}$
(10) $C_9H_{19}CONHC_2H_4NHCOC_9H_{19}$
(11) $C_{11}H_{23}CONHC_2H_4NHCOC_{11}H_{23}$
(12) $C_{17}H_{35}CONHC_2H_4NHCOC_{17}H_{35}$
(13) $(CH_3)_2CHC_{14}H_{35}CONHC_2H_4NHCOC_{14}H_{35}(CH_3)_2$
(14) $C_{21}H_{43}CONHC_2H_4NHCOC_{21}H_{43}$
(15) $C_{17}H_{35}CONHC_6H_{12}NHCOC_{17}H_{35}$
(16) $C_{21}H_{43}CONHC_6H_{12}NHCOC_{21}H_{43}$
(17) $C_{17}H_{33}CONHCH_2NHCOC_{17}H_{33}$
(18) $C_{17}H_{33}CONHC_2H_4NHCOC_{17}H_{33}$
(19) $C_{21}H_{41}CONHC_2H_4NHCOC_{21}H_{41}$
(20) $C_{17}H_{33}CONHC_6H_{12}NHCOC_{17}H_{33}$
(21) $C_8H_{17}NHCOC_2H_4CONHC_{18}H_{37}$
(22) $C_{10}H_{21}NHCOC_2H_4CONHC_{10}H_{21}$
(23) $C_{12}H_{25}NHCOC_2H_4CONHC_{12}H_{25}$
(24) $C_{18}H_{37}NHCOC_2H_4CONHC_{18}H_{37}$
(25) $C_{21}H_{43}NHCOC_2H_4CONHC_{21}H_{43}$
(26) $C_{18}H_{37}NHCOC_6H_{12}CONHC_{18}H_{37}$
(27) $C_{18}H_{35}NHCOC_4H_8CONHC_{18}H_{35}$
(28) $C_{18}H_{35}NHCOC_8H_{16}CONHC_{18}H_{35}$
(29) $C_{12}H_{25}OCONHC_{18}H_{37}$
(30) $C_{13}H_{27}OCONHC_{18}H_{37}$
(31) $C_{16}H_{33}OCONHC_{18}H_{37}$
(32) $C_{18}H_{37}OCONHC_{18}H_{37}$
(33) $C_{21}H_{43}OCONHC_{18}H_{37}$
(34) $C_{12}H_{25}OCONHC_{16}H_{33}$
(35) $C_{13}H_{27}OCONHC_{16}H_{33}$
(36) $C_{16}H_{33}OCONHC_{16}H_{33}$
(37) $C_{18}H_{37}OCONHC_{16}H_{33}$
(38) $C_{21}H_{43}OCONHC_{16}H_{33}$
(39) $C_{12}H_{25}OCONHC_{14}H_{29}$
(40) $C_{13}H_{27}OCONHC_{14}H_{29}$
(41) $C_{16}H_{33}OCONHC_{14}H_{29}$
(42) $C_{18}H_{37}OCONHC_{14}H_{29}$
(43) $C_{22}H_{45}OCONHC_{14}H_{29}$
(44) $C_{12}H_{25}OCONHC_{12}H_{37}$
(45) $C_{13}H_{27}OCONHC_{12}H_{37}$
(46) $C_{16}H_{33}OCONHC_{12}H_{37}$
(47) $C_{18}H_{37}OCONHC_{12}H_{37}$
(48) $C_{21}H_{43}OCONHC_{12}H_{37}$
(49) $C_{22}H_{45}OCONHC_{18}H_{37}$
(50) $C_{18}H_{37}NHCOOC_2H_4OCONHC_{18}H_{37}$
(51) $C_{18}H_{37}NHCOOC_3H_6OCONHC_{18}H_{37}$
(52) $C_{18}H_{37}NHCOOC_4H_8OCONHC_{18}H_{37}$
(53) $C_{18}H_{37}NHCOOC_6H_{12}OCONHC_{18}H_{37}$
(54) $C_{18}H_{37}NHCOOC_8H_{16}OCONHC_{18}H_{37}$
(55) $C_{18}H_{37}NHCOOC_2H_4OC_2H_4OCONHC_{18}H_{37}$
(56) $C_{18}H_{37}NHCOOC_3H_6OC_3H_6OCONHC_{18}H_{37}$
(57) $C_{18}H_{37}NHCOOC_{12}H_{24}OCONHC_{18}H_{37}$
(58) $C_{18}H_{37}NHCOOC_2H_4OC_2H_4OC_2H_4OCONHC_{18}H_{37}$
(59) $C_{16}H_{33}NHCOOC_2H_4OCONHC_{16}H_{33}$
(60) $C_{16}H_{33}NHCOOC_3H_6OCONHC_{16}H_{33}$
(61) $C_{16}H_{33}NHCOOC_4H_8OCONHC_{16}H_{33}$
(62) $C_{16}H_{33}NHCOOC_6H_{12}OCONHC_{16}H_{33}$
(63) $C_{16}H_{33}NHCOOC_8H_{16}OCONHC_{16}H_{33}$
(64) $C_{18}H_{37}OCOHNC_6H_{12}NHCOOC_{18}H_{37}$
(65) $C_{16}H_{33}OCOHNC_6H_{12}NHCOOC_{16}H_{33}$
(66) $C_{14}H_{29}OCOHNC_6H_{12}NHCOOC_{14}H_{29}$
(67) $C_{12}H_{25}OCOHNC_6H_{12}NHCOOC_{12}H_{25}$
(68) $C_{10}H_{21}OCOHNC_6H_{12}NHCOOC_{10}H_{21}$
(69) $C_8H_{17}OCOHNC_6H_{12}NHCOOC_8H_{17}$

In addition to the above, examples of the decoloring accelerator includes compounds expressed by the following formulas:

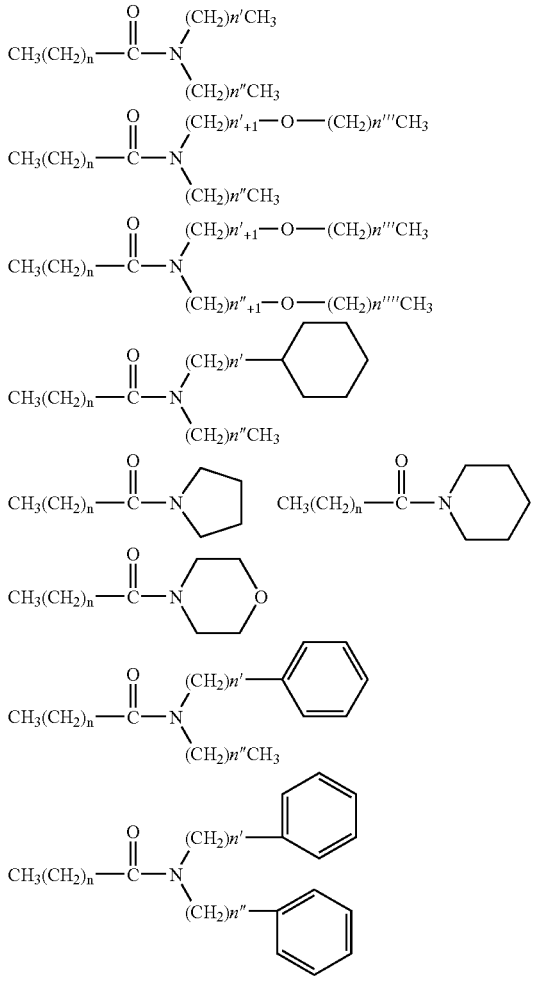

-continued

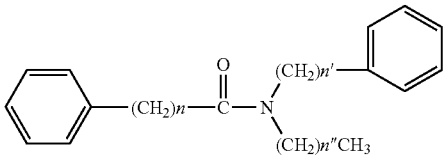

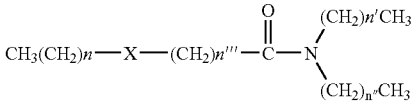

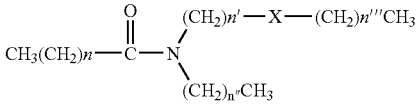

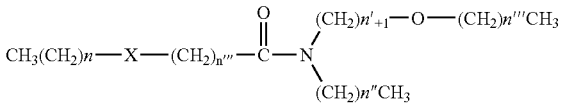

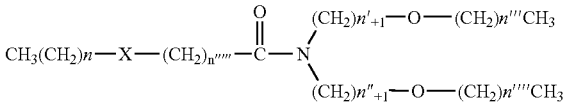

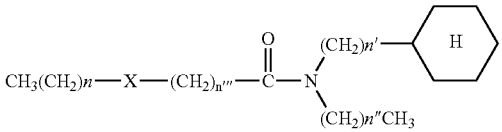

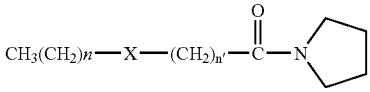

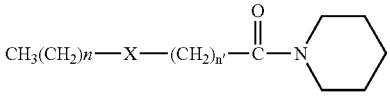

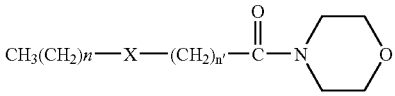

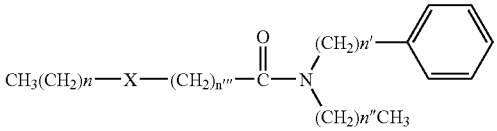

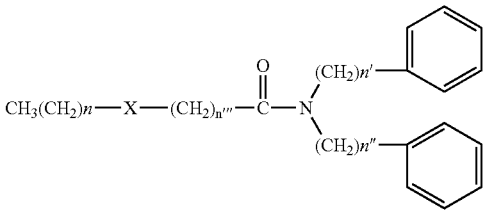

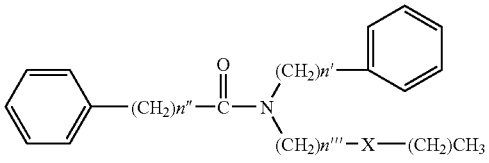

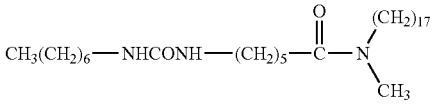

-continued

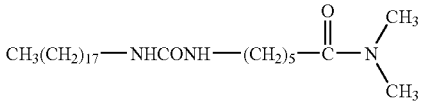

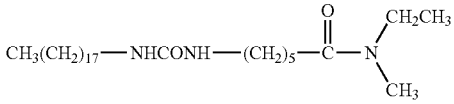

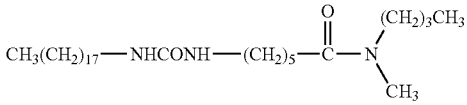

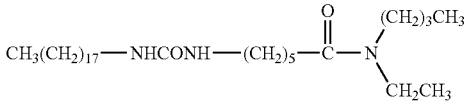

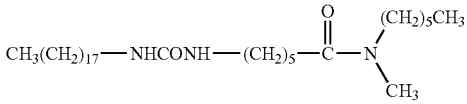

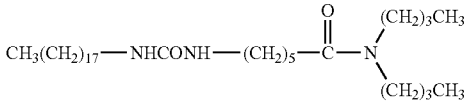

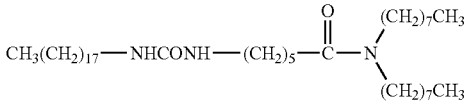

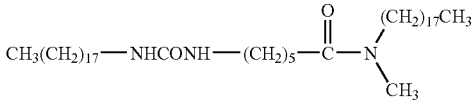

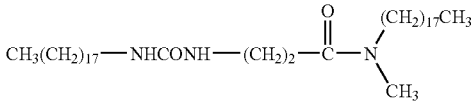

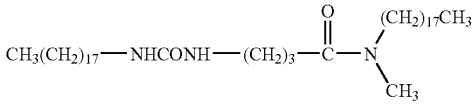

In the above formulae, each of n, n', n'', n''', and n'''' denotes an integer of 0 to 21, but it should be noted that all of n, n', n'', n''', and n'''' never be 5 or less at the same time. Moreover, X denotes a bivalent group including a nitrogen atom or an oxygen atom.

The amount of the decoloring accelerator is preferably 0.1 parts by mass to 300 parts by mass, more preferably 3 parts by mass to 100 parts by mass, with respect to 100 parts by mass of the color developer. In the case where the mount of the decoloring accelerator is less than 0.1 parts by mass, effects of the decoloring accelerator may not be effectively exhibited. In the case where the amount is more than 300 parts by mass, the color density may be decreased.

—Binder Resin—

The binder resin, which is used for forming a thermosensitive recording layer together with the leuco dye and the color developer, can be appropriately selected depending on the application without any restriction. Examples of the binder resin include polyvinyl chloride, polyvinyl acetate, vinylchloride-vinylacetate copolymer, ethylcellulose, polystyrene, styrene-containing copolymer, phenoxy resin, polyester, aromatic polyester, polyurethane, polycarbonate, polyester acrylate, polyester methacrylate, acrylic acid containing copolymer, maleic acid containing copolymer, polyvinylalcohol, modified polyvinylalcohol, hydroxylethylcellulose, carboxymethylcellulose, and starch. The binder resin serves to prevent the deviation of the respective materials in the composition due to heating for the recording erasures thereby to maintain the uniformly dispersed condition. Accordingly, the binder resin is preferred to be highly heat-resistant. Specifically, it is preferred that the binder resin is crosslinked by applying heat, ultra-violet radiation, electron beam, or the like. Hereinafter, the resin which is crosslinked in this manner is referred as a crosslinked resin.

The crosslinked resin is appropriately selected depending on the purpose without any restriction.

Specific examples of the crosslinked resin include: a resin having a group reactive with a cross-linking agent, such as acrylpolyol resin, polyesterpolyol resin, polyurethanepolyol resin, phenoxy resin, polyvinylbutyral resin, celluloseacetate propionate resin, and celluloseacetate butyrate resin; and a copolymer resin between a monomer having a group reactive with a cross-linking agent and another monomer.

Moreover, the crosslinked resin is preferably a crosslinked resin having a hydroxyl value of 70 mgKOH/g or more. The hydroxyl value is preferably 70 mgKOH/g or more, particularly preferably 90 mgKOH/g or more. In the case where the hydroxyl value is 70 mgKOH/g or more, the durability, surface hardness of the coating, and cracking resistance are improved. Whether or not a reversible thermosensitive recording material has the resin having a hydroxyl value of 70 (KOHmg/g) or more can be confirmed, for example, by analyzing the amount of remaining hydroxyl groups and the amount of ether bond.

Specific examples of the resin having a hydroxyl value of 70 mgKOH/g or more include an acrylpolyol resin, a polyesterpolyol resin, and a polyurethanepolyol resin. Among these, the acrylpolyol resin is particularly preferable in view of coloring stability and erasing ability.

The acrylpolyol resin has different characteristics depending on the compositional monomer thereof. Examples of a monomer having hydroxyl group as the compositional monomer, are hydroxyethylacrylate (HEA), hydroxypropylacrylate (HPA), 2-hydroxyethylmethacrylate (HEMA), 2-hydroxypropylmethacrylate (HPMA), 2-hydroxybutylmonoacrylate (2-HBA), 1,4-hydroxybutylmonoacrylate (1-HBA), and the like. Among these, the monomer having a primary hydroxyl group such as 2-hydroxyethylmethacrylate is suitably utilized, in light of superior cracking resistance and durability of the coating.

As a curing agent, examples include conventional isocyanate compounds, amine compounds, phenol compounds, epoxy compounds and the like. Among these compounds, the isocyanate compound is suitably utilized. The isocyanate compound used here may be selected from various derivatives of known isocyanate monomer such as urethane-modified, allophanate-modified, isocyanurate-modified, buret-modified, and carbodiimide-modified compounds, and blockedisocyanate compounds. Examples of the isocyanate monomer, which may yield the modified compounds, include tolylenediisocyanate (TDI), 4,4'-diphenylmethanediisocyanate (MDI), xylylenediisocyanate (XDI), naphthylenediisocyanate (NDI), paraphenylenediisocyanate (PPDI), tetramethylxylylenediisocyanate (TMXDI), hexamethylenediisocyanate (HDI), dicyclohexylmethanediisocyanate (HMDI), isophorondiisocyanate (IPDI), lysinediisocyanate (LDI), isopropylidenebis(4-cyclohexylisocyanate) (IP C), cyclohexyldiisocyanate (CHDI), and tolidinediisocyanate (TODI), but in the invention, the curing agent is not limited to these compounds.

Moreover, as the crosslinking promoter, a catalyst may be employed which is generally used for such reaction. Examples of the crosslinking promoter include tertiary amines such as 1,4-diaza-bicyclo(2,2,2)octane, and metal compounds such as organic tin compounds. Further, all of the introduced curing agent may not necessarily react for the crosslinking.

That is, the curing agent may be remained in unreacted condition. Such crosslinking reaction may progress with time; therefore, the presence of unreacted curing agent does not indicate that the crosslinking reaction has not progressed at all, nor suggests that the crosslinked resin does not exist, even if the unreacted curing agent is detected. Further, an immersion test of polymer into a solvent with a high solubility may be employed for distinguishing whether or not the polymer is in crosslinked condition. That is, the non-crosslinked polymer cannot remain in the solute since such polymer dissolves into the solvent, an analysis may be properly carried out for examining the existence of the polymer in the solute.

The thermosensitive recording layer may further contain known additives for improving coating ability of a coating solution of the thermosensitive recording layer, as required. Examples of the additives include a surfactant, a conducting agent, filler, an anti-oxidizing agent, an optical stabilizer, a coloring stabilizer, and the like.

The method for forming the thermosensitive recording layer includes to coat a coating liquid of the thermosensitive recording layer, and to dry the coated liquid. The method optionally includes a curing process, as required. To dry the coated liquid, a heat treatment may be performed at relatively high temperature for a short period, or at relatively low temperature for a long period, by using a temperature controlled bath or the like. As specific conditions for the curing reaction, it is preferably to heat at 30° C. to 130° C. for 1 minute to 150 hours, and is more preferably to heat at 40° C. to 100° C. for 2 minutes to 120 hours in view of reactivity. Since the productivity is important in the manufacturing process, it is difficult to attain a sufficient time for completing the crosslinking reaction. Therefore, the method for forming the thermosensitive recording layer may have a crosslinking process apart from the drying process. The crosslinking process is preferably to heat at 40° C. to 200° C. for 2 minutes to 120 hours.

The thickness of the thermosensitive recording layer can be appropriately adjusted depending on the purpose without any restriction. The thickness is, for example, preferably 1 μm to 20 μm, more preferably 3 μm to 15 μm. When the thermosensitive recording layer is too thin, the color density is lowered, and the contrast of an image may be lowered. When the thermosensitive recording layer is too thick, thermal distribution within the layer becomes large, and thus the layer may have uncolored portions without reaching the coloring temperature, and the predetermined color density cannot be obtained.

<Intermediate Layer>

The intermediate layer contains at least hollow particles, and may further contain binder resin. The intermediate layer optionally contains other substances, if necessary.

As the hollow particles, the particles having the aforementioned void ratio, particle diameters, and particle size distribution are used. In the present specification, the hollow particle defines a particle containing one or more voids therein.

The shell of the hollow particle is preferably formed of vinyl polymer having a crosslinked structure. The vinyl polymer having a crosslinked structure contains at least one vinyl monomer, and at least one crosslinking monomer.

The vinyl monomer can be appropriately selected depending on the purpose without any restriction. Examples of the vinyl monomer are: a monomer including a carboxylic acid therein such as acylic ester, ethylene propylene, vinyl acetate, styrene, acrylic nitrite, methacrylic nitrite, acrylic acid, methacrylic acid, succinic acid, and itaconic acid; metal salt of a carboxylic acid such as magnesium acrylate, calcium acrylate, zinc acrylate, magnesium methacrylate, calcium methacrylate, and zinc methacrylate; a compound including a group reacting with a carboxylic acid therein, such as N-methylol acrylic amide, N-methylol methacrylic amide, glycidyl acrylate, glycidyl methacrylate, 2-hydroxy ethyl (meth)acrylate, 2-hydroxy propyl(meth)acrylate, 2-hydroxy butyl (meth)acrylate, 2-hydroxy-3-pjemoxy propyl acrylate, N,N-dimethyl aminoethyl(meth)acrylate, N,N-dimethylaminopropyl methacrylates, magnesium monoacrylate, and zinc monoacrylate; and a monomer such as acrylic amide, methacrylic amide, N,N-dimethylacrylic amide, N,N-dimethyl methacrylic amide, methyl methacrylate, t-butyl methacrylate, isobornyl (meth)acrylate, cyclohexyl methacrylate, benzyl methacrylate, N-vinylypyrrolidone, styrene, N-phenyl maleimide, N-naphthyl maleimide, N-cyclohexyl maleimide and methyl maleimide.

The crosslinking monomer can be appropriately selected depending on the purpose without any restriction. Examples of the crosslinking monomer are ethylene glycol di(meth) acrylate, propylene glycol di(meth)acrylate, diethylene glycol di(meth)acrylate, 1,4-butane diol di(meth)acrylate, 1,6-hexane diol di(meth)acrylate, trimethylol propane tri(meth) acrylate, glycerine di(meth)acrylate, triethylene glycol di(meth)acrylate, PEG#200 di(meth)acrylate, PEG#400 di(meth)acrylate, PEG#600 di(meth)acrylate, 1,3-butane diol di(meth)acrylate, neopenthyl glycol di(meth)acrylate, 1,10-decane diol di(meth)acrylate, pentaerythritol tri(meth)acrylate, pentaerythritol tetra(meth)acrylate, pentaerythritol hexa (meth)acrylate 3-acryloyloxy glycerin monoacrylate, dimethylol tricyclodecane di(meth)acrylate, triaryl formal tri (meth)acrylate, polyethylene glycol dimethacrylate, polypropylene glycol dimethacrylate, 2,2'-bis(4-acryloxy diethoxyphenyl)propane, trimethylol propane trimethacrylate, phthalic acid diallyl, dicinyl benzene, and the like.

The method for forming hollow particles can be appropriately selected depending on the purpose without any restriction. For example, polymer particles each having a shell of a polymer encapsulating a volatile compound as a core material are formed, and then the polymer particles are heated to foam to thereby yield hollow particles.

The glass transition temperature (Tg) of the hollow particles, i.e. the shell material, is preferably 45° C. or more, more preferably 60° C. or more, further preferably 90° C. or more. In the case where the hollow particles has Tg of less than 45° C., blocking may occur at the time when the obtained reversible thermosensitive recording medium is rolled up after the coating process, or the hollow particles may be easily crushed, and thus the functions of the hollow particle may not be sufficiently exhibited.

—Binder Rein—

The binder resin can be appropriately selected depending on the purpose without any restriction. Examples thereof are urea resin, melamine resin, phenol resin, epoxy resin, vinyl acetate resin, vinyl acetate-acryl copolymer, ethylene-vinyl acetate copolymer, acrylic resin, polyvinyl ether resin, vinyl chloride-vinyl acetate copolymer, polystyrene resin, polyester resin, polyurethane resin, polyamide resin, chloridized polyolefin resin, polyvinyl butyral, acrylic ester-containing copolymer, methacrylic ester-containing copolymer, natural rubber, cyanoacrylate resin, silicone resin, and the like.

Moreover, a hydrophobic resin, an ultraviolet curing resin, and an aqueous polymer can be used as the binder resin.

Examples of the hydrophobic resin are: latex of styrene/butadiene copolymer or butadiene/acrylic ester copolymer; and an emulsion of vinyl chloride, vinyl chloride/acrylic acid copolymer, styrene/acrylic ester copolymer, acrylic ester resin, or polyurethane resin.

Examples of the ultraviolet curing resin are urethane acrylate-containing water soluble ultraviolet curing resin, epoxy acrylate-containing water soluble ultraviolet curing resin, alkoxy acrylate-containing resin, polyurethane acrylate-containing ultraviolet curing emulsion, acrylic monomer, urethane acrylic oligomer, ether containing urethane acrylate oligomer, ester-containing urethane acrylate oligomer, and polyester acrylate oligomer.

The aqueous polymer includes a water soluble polymer and a water dispersible polymer. Examples of the water soluble polymer are: various modified polyvinyl alcohol, such as complete saponified polyvinyl alcohol, carboxyl modified polyvinyl alcohol, partially saponified polyvinyl alcohol, sulfonate modified polyvinyl alcohol, silyl modified polyvinyl alcohol, acetoacetyl modified polyvinyl alcohol, and di-acetone modified polyvinyl alcohol; starch or a derivative thereof; a cellulose derivative, such as methoxy cellulose, hydroxylethyl cellulose, carboxylmethyl cellulose, methyl cellulose, and ethyl cellulose; and a polymer or the like, such as polyacrylic acid soda, polyvinyl pyrrolidone, acrylic amide/acrylic acid ester copolymer, alkali salt of styrene/anhydrous maleic acid, alkali salt of isobutylene/anhydrous maleic acid copolymer, polyacrylic amide, alginic acid of soda, gelatin, and casein.

Examples of the water dispersible polymer are: latex of styrene/butadiene copolymer or butadiene/acrylic ester copolymer; and an emulsion of vinyl chloride, vinyl chloride/acrylic acid copolymer, styrene/acrylic ester copolymer, acrylic ester resin, or polyurethane resin.

The content of the binder resin is preferably 100 parts by mass to 300 parts by mass, more preferably 100 parts by mass to 200 parts by mass, with respect to 100 parts by mass of the hollow particles. In the case where the content is less than 100 parts by mass, voids in between the hollow particles are remained without being completely filled with the binder resin, and thus the color density may be lowered. In the case where the content is more than 300 parts by mass, the existing ratio of the hollow particles is lowered within the intermediate layer, and thus the heat insulating ability of the intermediate layer is decreased, which may cause decline of the sensitivity.

It is preferred that the intermediate layer is added with an alkaline viscosity improver on the purpose of improving head matching property/the alkali viscosity improver is a binder which improves viscosity thereof under alkaline state. In the present invention, the alkaline viscosity improver may be used singly. However, to make the binder composition stably present as dispersing particles, it is preferred to use in combination with carboxylized latex which includes a copolymer of unsaturated carboxylic acid. Such a carboxylized latex improves the viscosity thereof when pH is increased. This is because a polymer having a plurality of carboxyl groups in the surface of a particle of the carboxylized latex dissolve in water. Consequently, the viscosity of the binder mentioned above is further improved. In order to maintain the coating liquid of the intermediate layer alkaline, it is necessary to add a pH controlling agent. As the pH controlling agent, for example, an aqueous solution of $NH_3$ is used.

The alkaline viscosity improver can be appropriately selected depending on the purpose without any restriction. Preferable examples thereof include emulsion latex containing styrene-butadiene copolymer. Since the alkaline viscosity improver strongly binds hollow particles with each other, the thermal head matching property is greatly improved compared to the case where the binder resin is used without the alkaline viscosity improver.

The content of the alkaline viscosity improver is preferably 1 part by mass to 80 parts by mass, more preferably 5 parts by mass to 50 parts by mass, with respect to 100 parts by mass of the hollow particles.

The intermediate layer optionally contains assistant additive compositions such as filler, thermomelting materials and surfactants which are typically used for this type of a thermosensitive recording medium, together with the hollow particles and the binder resin, if necessary. It is preferred that a viscosity of 20% water dispersion liquid of the hollow particles at a liquid temperature of 20° C. is not greater than 200 mPa·s to uniformly apply the coating liquid of the intermediate layer to a support at a high speed. When the viscosity is more than 200 mPa·s, the viscosity of the coating liquid of the intermediate layer becomes too large, and thus the resulting coating may become uneven.

The coating method of the coating liquid of the intermediate layer is, for example, a wire bar coating method, an air knife coating method, a blade coating method, a rod blade coating method, a photogravure coating method, a roller coating method, a spray coating method, a dip coating method, an extrusion coating method, or the like.

After forming the intermediate layer, a calendar treatment can be carried out so as to make the surface of the intermediate layer formed on the support even smoother.

The thickness of the intermediate layer can be adjusted depending on the purpose without any restriction. The thickness is preferably 3 μm to 5 μm, more preferably 5 μm to 30 μm.

<Support>

The support does not have any restriction in terms of its shape, structure, size, and the like, and can be selected depending on the purpose. The shape is, for example, in the form of a flat plate, the structure is, for example, a singly-layered structure or a laminate structure, and the size is, for example, adjusted depending on the size of the reversible thermosensitive recording medium.

The material of the support is, for example, an inorganic material or an organic material. Examples of the inorganic material are glass, quartz, silicon, silicon oxide, aluminum oxide, $SiO_2$, metal, and the like. Examples of the organic material are paper, cellulose derivative such as cellulose triactate, synthetic paper, polyethylene terephthalate, polycarbonate, polystyrene, polymethylmethacrylate, and the like. One of these may be used for the support, or two or more of these may be used in combination.

The support is preferably improved its surface texture by being subjected to a treatment such as a corona discharging treatment, oxidation reaction treatment by using chromic acid and the like, etching treatment, treatment for easy-adhesion, charge inhibiting treatment, and the like. In addition, the support is preferably added with a white pigment such as titanium oxide so as to tint in white.

The thickness of the support can be appropriately adjusted depending on the purpose without any restriction. It is preferably a few micrometers to a few millimeters, moer preferably 10 μm to 2,000 μm, further preferably 60 μm to 150 μm.

The reversible thermosensitive recording medium of the invention may further contain a protective layer disposed on the thermosensitive recording layer.

The protective layer preferably contains a crosslinked resin. Examples of the crosslinked resin include heat curing resin also used for the thermosensitive recording layer, ultraviolet curing resin, and electron beam curing resin. The protective layer may further contain inorganic filler, organic filler, lubricant, ultraviolet absorbent, and the like.

The thickness of the protective layer is preferably 0.1 μm to 20 μm, more preferably 0.3 μm to 10 μm.

The solvent used for the coating liquid of the protective layer, a dispersing device for the coating liquid, a binder, a coating method, a drying method, a curing method and the like are the same as the conventional method used for the aforementioned thermosensitive recording layer.

Furthermore, an additional protective layer may be disposed between the thermosensitive recording layer and the protective layer on the purpose of an improvement of the adhesion, an inhibition of deterioration of the thermosensitive recording layer due to the application of the protective layer, a prevention of transfer of the additives contained in the thermosensitive recording layer to the protective layer or vice versa. The thickness of the additional protective layer is preferably 0.1 μm to 20 μm, more preferably 0.3 μm to 10 μm.

—Heat Insolating Layer—

The reversible thermosensitive recording medium may further contain a heat insolating layer disposed in between the support and the thermosensitive recording layer in order to improve coloring sensitivity by efficiently using heat applied to the reversible thermosensitive recording medium at the time of recording. The heat insolating layer is formed by applying a binder resin containing organic or inorganic fine hollow particles.

The resin usable for the heat insolating layer is the same as the one used for the thermosensitive recording layer, the intermediate layer, or the protective layer. The heat insolating layer may contain inorganic filler such as calcium carbonate, magnesium carbonate, titanium oxide, silicon oxide, aluminum hydroxide, kaolin, talk, and the like, or various organic filler. In addition, the heat insolating layer may contain a surfactant, a dispersant, and the like.

When the heat insolating layer is disposed, cracking resistance or inhibition of fin is improved. The heat insolating layer can be formed in the same manner as described in the aforementioned other layers.

The reversible thermosensitive recording medium can be appropriately prepared in the form of a card, a sheet, a label, a roll, or the like, without any restriction.

The reversible thermosensitive recording medium in the form of the card is applied as a prepaid card, a point card, a credit card, and the like. The reversible thermosensitive recording medium in the form of the sheet such as having a size of the general document, i.e., A4 size is widely applied for test-printing, or temporary outputs such as a general document, a specifications form for managing processes, a circulation, a meeting document, and the like, as the sheet size thereof has larger margin for printing larger than the card size thereof which is smaller than the sheet size.

Moreover, the reversible thermosensitive recording medium in the form of roller is integrated into a displaying device having printing-erasing parts, and is applied for a displaying board, a notice board, or electric black board. Since such the displaying device does not generate dusts or dirt, it can be suitably used in a clean room.

(Reversible Thermosensitive Recording Member)

The reversible thermosensitive recording member of the present invention contains an information-memorizing part and a reversible display part, and the reversible display part contains the reversible thermosensitive recording medium of the present invention. The reversible thermosensitive recording member optionally contains other members, if necessary.

According to the reversible thermosensitive recording member of the invention, the reversibly thermosensitive layer and the information-memorizing part are provided in one card (integrated), and a part of the recorded information of the information-memorizing part is displayed on the thermosensitive layer, thereby the owner of the card may be convenient in that the information can be confirmed by only viewing the card without a particular device. Further, in the case that the content of the information-memorizing part is overwritten, the recording medium may be repeatedly utilized by overwriting the display of the thermosensitive recording part.

The member containing the information-memorizing part and the reversible displaying part may be classified in the following two types.

(1) A part of the member containing the information-memorizing part is utilized as a support of the reversible thermosetting recording medium, and the thermosensitive layer is disposed on the support directly.

(2) A thermosensitive layer is disposed separately on a support to form a reversible thermosensitive recording medium, and the support is adhered to the member containing the information-memorizing part.

In these cases of (1) and (2), the position of the disposed information-memorizing part may be the opposite side of the thermosensitive layer on the support of the recording medium, between the support and the thermosensitive layer, or on a part of the thermosensitive layer, provided that the information-memorizing part and the reversible displaying part are designed to perform their functions.

The information-memorizing part does not have any restriction, but for example, may be preferably formed of a magnetic thermosensitive layer, magnetic stripe, IC memory, optical memory, RF-ID tag card, hologram, and the like. In the sheet medium of which the size is over the card size, the IC memory and RF-ID tag are preferably employed. By the way, the RF-ID tag is composed of an IC chip and an antenna connected to the IC chip.

The magnetic thermosensitive layer may be formed by coating on a support a coating material containing conventional iron oxide, barium ferrite etc. and a vinylchloride resin, a urethane resin, a nylon resin etc., or by vapor deposition, spattering etc. without using a resin. The magnetic thermosensitive layer may be provided on the face of the support opposite to the thermosensitive layer, between the support and the thermosensitive layer, or on a part of the thermosensitive layer. Further, the reversible thermosensitive material for displaying may be employed for the memorizing part in a form of barcode, two dimensional code and the like.

As for the hologram, the rewritable type is preferred, for example, the rewritable hologram in which coherent light is written on a liquid crystal film of azobenzene polymer is exemplified.

The member containing the information-memorizing part typically includes a card, disc, disc cartridge, and tape cassette. Specifically, examples of the member include a thicker card such as IC card and optical card; disc cartridge containing an information-rewritable disc such as flexible disk, optical magnetic disc (MD) and DVD-RAM; disc in which disc cartridge is not utilized, e.g. CD-RW; overwrite type disc such as CD-R; optical information recording medium with phase-changing recording material (CD-RW); and video cassette.

Further, the member containing the information-memorizing part and the reversible displaying part may exhibit remarkably increased availability. That is, in case of a card for example, the owner of the card can confirm the information only by viewing the card without a particular device through displaying on the thermosensitive layer a part of the information memorized in the information-memorizing part.

The information-memorizing part may be properly selected depending on the application without any restriction, provided that the necessary information may be recorded, for example, a magnetic recording, contact type IC, non-contact type IC, and optical memory are exemplified.

More specifically, the reversible recording medium of the invention may be appropriately employed for the reversible thermosensitive recording label, reversible thermosensitive recording member, image-processing apparatus, and image-processing method. In the invention, "surface of the reversible thermosensitive recording medium" means the surface on the side of the thermosensitive layer, which surface means not only that of the protective layer, but also all of or part of the surface which contact with the thermal head during the printing and erasing, such as the surface of printing layer or over head layer.

(Reversible Thermosensitive Recording Label)

The reversible thermosensitive recording label contains either or both of an adhesive layer and tacky layer on an exposed surface of the reversible thermosensitive recording medium opposite to the exposed surface on which an image is formed (in the case that the thermosensitive layer exists on the support, an exposed surface of the support opposite to the surface on which an image is formed), and optionally contains the other layers appropriately selected depending on the necessity. Further, in the case that the support of the reversible thermosensitive recording medium is of heat fusion, the adhesive layer or tacky layer on a surface of the support opposite to the surface on which an image is not necessarily formed.

The shape, configuration, size and the like of the adhesive layer or tacky layer may be appropriately selected depending on the application without any restriction. The shape may be sheet-like or film-like; the configuration may be of single layer or laminated layers; and the size may be larger or smaller than the thermosensitive layer.

The material of the adhesive layer or tacky layer may be appropriately selected depending on the application without any restriction. Examples of the material include a urea resin, a melamine resin, a phenolic resin, an epoxy resin, a polyvinyl acetate resin, a vinyl acetate-acrylic copolymer, an ethylene-vinyl acetate copolymer, an acrylic resin, a polyvinyl ether resin, a vinyl chloride-vinyl acetate copolymer, a polystyrene resin, a polyester resin, a polyurethane resin, a polyamide resin, a chlorinated polyolefin resin, a polyvinyl butyral resin, an acrylic ester containing copolymer, a methacrylic ester containing copolymer, natural rubber, a cyanoacrylate resin, a silicone resin. These may be used alone or in combination. Further, the material may be of hot-melt type, and may be used either with a disposable release paper or without a disposable release paper.

The reversible thermosensitive recording label is normally utilized in a configuration laminated to a substrate sheet such as a card, in which the reversible thermosensitive recording label may be laminated on the entire or part of the substrate sheet, or on one side or both sides.

The shape, configuration, size and the like of the substrate sheet may be appropriately selected depending on the application without any restriction. The shape may be plate-like or the like; the configuration may be of single layer or laminated layers; and the size may be properly selected depending on the size of the reversible thermosensitive recording medium. For example, the substrate may be a sheet or laminated body formed of a chlorine-containing polymer, a polyester resin, a biodegradable plastic resin, or the like.

The chlorine-containing polymer may be appropriately selected depending on the application without any restriction; examples of the polymer include polyvinyl chloride, vinyl chloride-vinyl acetate copolymer, vinylchloride-vinylacetate-vinylalcohol copolymer, vinylchloride-vinylacetate-maleicacid copolymer, vinylchloride-acrylate copolymer, polyvinylidenechloride, vinylidenechloride-vinylchloride copolymer, and vinylidenechloride-acrylonitrile cop olymer.

Examples of the polyester resin include polyethylene terephthalate (PET), polybutylene terephthalate (PBT), alternatively condensed esters of acid ingredients such as terephthalic acid, isophthalic acid, and alcohol ingredients such as ethylene glycol, cyclohexanedimethanol (e.g. PETG, trade name by Eastman Chemical Co.).

Examples of the biodegradable plastic resin include a natural polymer resin containing polylactic acid, starch, denaturated polyvinyl alcohol and the like, and a microbiological product resin including beta-hydroxybutyric acid and beta-hydroxyvaleric acid.

Further, the substrate may be synthetic resin sheet or paper formed of a polyacetate resin, a polystyrene (PS) resin, an epoxy resin, a polyvinylchloride (PVC) resin, a polycarbonate (PC) resin, a polyamide resin, an acrylic resin, a silicone resin and the like. These materials may be appropriately combined or laminated.

When either or both of the adhesive layer and the tacky layer exist in the reversible thermosensitive recording label, the reversible thermosensitive recording label may be affixed on an entire or part of a thicker substrate such as polyvinylchloride card with magnetic stripe to which the thermosensitive layer is usually difficult to be affixed, thereby a part of the information memorized in magnetic may be displayed.

The reversible thermosensitive recording label may be an alternative to a thicker card such as IC card and optical card, flexible disc, disc cartridge containing rewritable disc such as optical magnetic recording disc (MD) and DVD-RAM, disc without disc cartridge such as CD-RW, write-once disc such as CD-R, optical information recording medium (CD-RW) based on phase-change recording material, and display label on video cassette.

Figure 2:
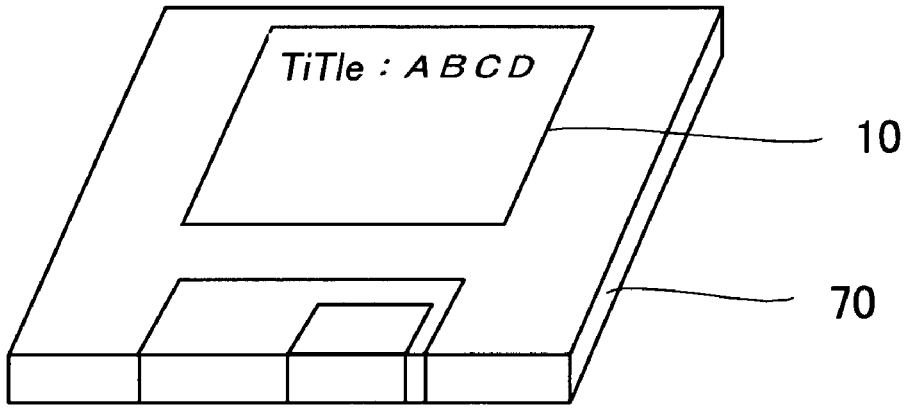
FIG. 2 is a diagram showing an example of a reversible thermosensitive recording label attached on a disk cartridge of Mini Disk.

FIG. 2 exemplifies the reversible thermosensitive recording label 10 of the invention affixed to MD disc cartridge 70. In this case, such application is allowable that the displayed content is automatically altered depending the alternation of the memorized content in the MD. Further, in a case of disc without disc cartridge such as CD-RW, the reversible thermosensitive recording label of the invention may be directly affixed to the disc.

Figure 3:
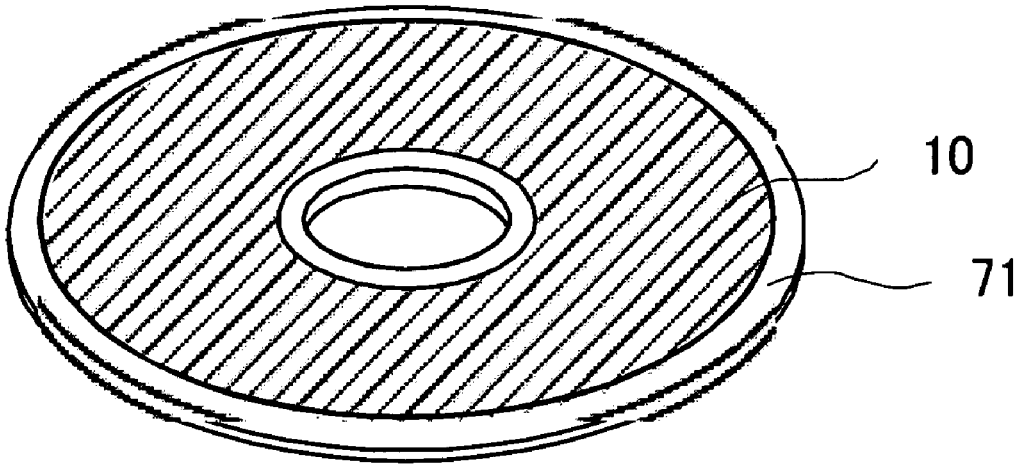
FIG. 3 is a diagram showing an example of a reversible thermosensitive recording label attached on CD-RW.

FIG. 3 exemplifies the reversible thermosensitive recording label 10 of the invention affixed to CD-RW 71. In this case, the reversible thermosensitive recording label is affixed on a write-once disc such as CD-R in place of CD-RW, then a part of the memorized information in the CD-R may be rewritten and displayed.

Figure 4:
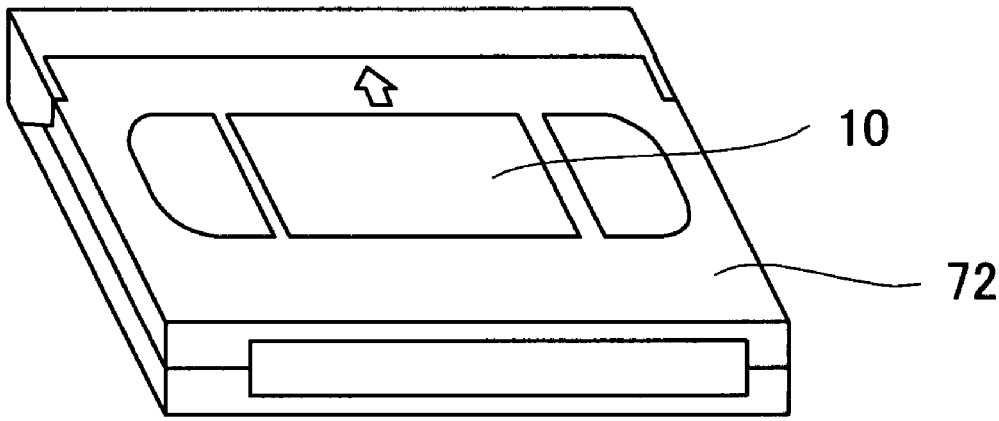
FIG. 4 is a diagram showing an example of a reversible thermosensitive recording label for use as a display label of a video tape cassette.

FIG. 4 shows an example of the cases where the reversible thermosensitive recording label 10 of the invention is affixed to a video cassette 72. In this case, such application is allowable that the display is automatically altered depending on the change of the memories in the video cassette.

The method for applying the reversible thermosensitive functions onto the card, disk, disk cartridge, or tape cassette is, other than a method of applying the reversible thermosensitive recording label thereon, a method of directly coating a coating liquid of the thermosensitive recording layer thereon so as to form the reversible thermosensitive recording layer, a method of transferring the thermosensitive recording layer on the card, disk, disk cartridge, or tape cassette, wherein the thermosensitive recording layer is prepared on another support in advance, or the like. In the method of transferring the thermosensitive recording layer, the adhesive layer or tacky layer of hot melt type or the like may be disposed on the thermosensitive recording layer. In the case that the reversible thermosensitive recording layer or the thermosensitive recording layer is applied onto a rigid material such as a card, disk, disk cartridge, and tape cassette, it is preferable that an elastic layer or sheet which serves as a cushion is disposed between the rigid base body and the reversible thermosensitive recording label or thermosensitive recording layer.

Either or both of the reversible thermosensitive recording label and reversible thermosensitive recording member of the present invention can be subjected to image processing by means of various image processing devices in accordance with various image processing methods without any restriction, but image formation and erasure thereon is particularly suitably performed by means of the image-processing apparatus of the present invention below.

(Image-Processing Method and Image-Processing Apparatus)

The image-processing apparatus of the present invention contains at least one of an image-forming unit and an image-erasing unit, and further contains appropriately selected other units or means, e.g. a conveying unit, and a controlling unit, if necessary.

The image-processing method of the present invention contains at least one of heating a reversible thermosensitive recording medium so as to form an image thereon, and heating the reversible thermosensitive recording medium so as to erase the image formed thereon. The image-processing method of the invention further contains appropriately selected other steps, e.g. a conveying step, and a controlling step, if necessary.

The image-processing method of the invention is suitably performed by means of the image-processing apparatus of the invention, at least one step of heating a reversible thermosensitive recording medium so as to form an image thereon, and heating the reversible thermosensitive recording medium so as to erase the image formed thereon can be performed by means of at least one of the image-forming unit and the image-erasing unit. Moreover, the aforementioned other steps in the image-processing method can be performed by means of the aforementioned other units or means.

—Image-Forming Unit and Image-Erasing Unit—

The image-forming unit is the unit in which images are formed through heating the reversible thermosensitive recording medium. The image-erasing unit is the unit in which images are erased through heating the reversible thermosensitive recording medium.

The image-forming unit may be properly selected depending on the application, from a thermal head, laser and the like. These may be used alone or in combination.

The image-erasing unit may be properly selected depending on the application, from a hot stamp, ceramic heater, heat roller, heat block, hot blow, thermal head, laser irradiation apparatus and the like. Among these, the ceramic heater is preferred. By means of the ceramic heater, the apparatus may be miniaturized, the erasing condition may be stabilized, and images with high contrast may be obtained. The operating temperature of the ceramic heater may be properly selected depending on the application, preferably 90° C. or more, more preferably 100° C. or more, most preferably 115° C. or more, for example.

By means of the thermal head, the apparatus may be minitualized still, in addition, the electric power consumption may be saved, and the power supply may be replaced to a handy type. Further, the performance of image forming and erasing may be combined into one thermal head, thereby the apparatus may be minitualized still more. In the case that the recording and erasing are achieved with one thermal head, once the prior images are erased entirely, then new images may be recorded; alternatively an overwrite type may be provided in which the individual image is erased at variable energy level and new images are recorded. In the overwrite type, the total period for recording and erasing is relatively short, resulting in the speed-up of the recording.

In the case that the reversible thermosensitive recording member (card) with the thermosensitive layer and information memorizing part is utilized, the reading unit and rewriting unit for the memories in the information memorizing part are included in the above-noted apparatus.

The conveying unit may be appropriately selected depending on the application, provided that the unit is configured to sequentially convey the reversible thermosensitive recording media; a conveying belt, conveying roller, and combination of conveying belt and conveying roller may be exemplified.

The controlling unit may be properly selected depending on the application, provided that the unit performs controlling the respective steps, from a sequencer, computer and the like.

Here, one aspect of the image-processing method through the image-processing apparatus will be explained with reference to FIGS. 5A and 5B. The image-processing apparatus shown in FIG. 5A contains thermal head 53 as the heating unit, ceramic heater 38, magnetic head 34, conveying rollers 31, 40 and 47.

Figure 5A:
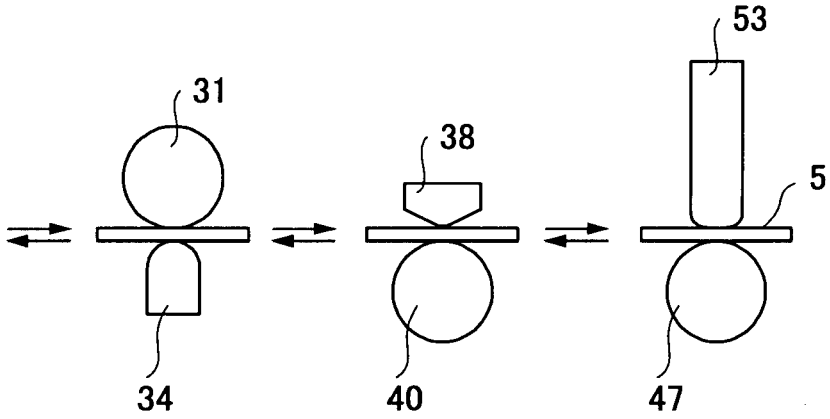
FIG. 5A is a diagram showing an example of the image-processing apparatus of the present invention.

As shown in FIG. 5A, in this image-processing apparatus, the information memorized in the magnetic thermosensitive layer of the reversible thermosensitive recording medium is read by means of the magnetic head initially. Then, heating by means of the ceramic heater erases the images recorded in the thermosensitive layer. Further, the new information processed based on the information read by the magnetic head is recorded in the thermosensitive layer with the thermal head. Thereafter, the information in the magnetic thermosensitive layer is replaced to the new information.

In the image-processing apparatus shown in FIG. 5A, the reversible thermosensitive recording medium 5 in which the magnetic thermosensitive layer is provided on the opposite side of the thermosensitive layer, is conveyed along the conveying root (shown by back-forth arrows) or conveyed in the reverse direction along the conveying root. The reversible thermosensitive recording medium 5 is subjected to magnetic recording or erasing in the magnetic thermosensitive layer between the magnetic head 34 and the conveying roller 31, and subjected to a heat treatment for erasing images between the ceramic heater 38 and the conveying roller 40, and then images are formed between the thermal head 53 and conveying roller 47, thereafter discharged out of the apparatus. As explained earlier, the ceramic heater 38 is preferably set at 110° C. or more, more preferably 112° C. or more, most preferably 115° C. or more. By the way, the rewriting of the magnetic recording may be before or after the image erasing by means of the ceramic heater. In addition, the recording medium is conveyed reversibly after passing between the ceramic heater 38 and conveying roller 40, or after passing between the thermal head 53 and conveying roller 47, if necessary. The duplicated heat treatment by means of ceramic heater 38, and the duplicated printing by means of thermal head 53 may be applied in some instances.

Figure 5B:
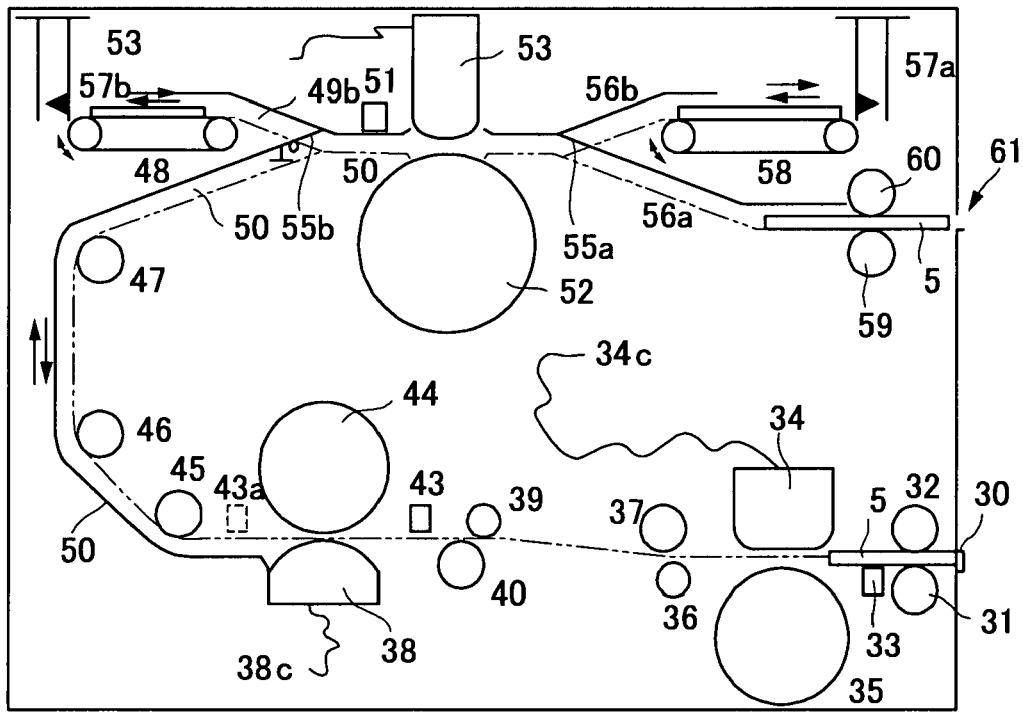
FIG. 5B is a schematic diagram showing an example of the image-processing apparatus of the present invention.

In the image-processing apparatus shown in FIG. 5B, the reversible thermosensitive recording medium 5, inserted from the entrance 30, progresses along the conveying root 50 shown by alternate long and short dash lines, alternatively progresses reversibly along the conveying root 50 in the apparatus. The reversible thermosensitive recording medium 5, inserted from the entrance 30, is conveyed in the apparatus by means of the conveying roller 31 and the guide roller 32. When it reaches at the predetermined position on the conveying route 50, the existence is detected by means of sensor 33 and controlling device 34*c*, the magnetic thermosensitive layer is subjected to magnetic recording or erasing between the magnetic head 34 and the platen roller 35, then the reversible thermosensitive recording medium passes between the guide roller 36 and the conveying roller 37 and subsequently between the guide roller 39 and the conveying roller 40, and is subjected to a heat treatment for erasing images between the ceramic heater 38, recognizing the existence by sensor 43 and operating through the ceramic heater controlling device 38*c*, and platen roller 44, then is conveyed along the conveying root 50 by means of conveying rollers 45, 46 and 47, is subjected to image forming between thermal head 53, recognizing the existence at a certain position by sensor 51 and operating through the thermal head controlling device 53*c*, and platen roller 52, and is discharged outside from conveying root 56*a* through exit 61 by means of conveying roller 59 and guide roller 60. By the way, the temperature of ceramic heater 38 may be properly set depending on the application, as explained earlier, the ceramic heater 38 is preferably set at 90° C. or more, more preferably 100° C. or more.

If desired, the reversible thermosensitive recording medium 5 may be directed to conveying route 56*b* by switching the conveying root changing device 55*a*, reversible thermosensitive recording medium 5 is subjected to the heat treatment again between thermal head 53 and platen roller 52, by means of conveying belt 58 which moves reversibly by the action of limit switch 57*a* which operates by a pressure of reversible thermosensitive recording medium 5, then conveying through conveying root 49*b*, being connected by changing the conveying root changing device 55*b*, limit switch 57*b* and conveying belt 48 in order, and then is discharged outside from conveying root 56*a* through exit 61 by means of conveying roller 59 and guide roller 60. Further, such blanched conveying root and conveying root changing device may be provided on both sides of the ceramic heater 38. In the case, sensor 43*a* is preferably provided between platen roller 44 and conveying roller 45.

With the image-processing apparatus and image-processing method of the present invention, it can be realized an inhibition dusts adhesion to a heat source, e.g. a thermal head, an excellent erasing ability at high conveying speed, and a formation of an image having high coloring density, as the reversible thermosensitive recording medium of the present invention is used as a thermosensitive recording medium.

The invention will be described in more detail below with reference to examples and comparative examples, but the invention is not limited, within the scope of the invention, to the following examples. Wherever "parts" or "%" are mentioned in the following, they are based on weight unless otherwise mentioned.

SYNTHESIS EXAMPLE 1

—Preparation of Hollow Particles A—

55 g of sodium chloride was dissolved in 160 g of ion exchanged water, the thus obtained solution was added with 1.0 g of a condensation product of adipic acid and diethanol amine, and 25 g of 20% colloidal silica aqueous solution. Thereafter, the thus obtained solution was adjusted its pH to be in the range of from pH 3.8 to pH 4.2 by using sulfuric acid, and was uniformly mixed to thereby obtain an aqueous phase.

45 g of acrylonitrile, 16 g of methacrylonitrile, 5 g of N-methylolacrylic amide, 23 g of isobornyl methacrylate, 0.1 g of ethylene glycol dimethacryate, 0.3 g of azobisisobutylol nitrile, 0.1 g of 1,1-azobis(cyclohexane-1-carbonitrile)(a product name: V-40, a manufacturer: Wako Pure Chemical Industries, Ltd.), and 15 g of isobutene were mixed, stirred, and dissolved to thereby obtain an oil phase.

Thereafter, the obtained aqueous phase and oil phase were mixed and stirred at 4,000 rpm for 1 minute by means of a homomixer so a to obtain a suspension. Thus suspension was moved to a separable flask, nitrogen therein was replaced, and the suspension was allowed to react at 70° C. for 6 hours, and then at 90° C. for 14 hours while stirring. After the reaction, the reacted suspension was cooled, and filtrated to thereby obtain capsule particles. The thus obtained capsule particles were heated and foamed to thereby yield hollow particles A.

SYNTHESIS EXAMPLE 2

—Preparation of Hollow Particles B—

The hollow particles B were prepared in the same manner as in Synthesis Example 1, provided that a revolution of the homomixer was changed to 3,500 rpm.

SYNTHESIS EXAMPLE 3

—Preparation of Hollow Particles C—

The hollow particles C were prepared in the same manner as in Synthesis Example 1, provided that N-methylol acrylamide was not added.

SYNTHESIS EXAMPLE 4

—Preparation of Hollow Particles D—

The hollow particles D were prepared in the same manner as in Synthesis Example 1, provided that the added amount of isobornyl methacrylate was changed to 20 g.

SYNTHESIS EXAMPLE 5

—Preparation of Hollow Particles E—

The hollow particles E were prepared in the same manner as in Synthesis Example 1, provided that the added amount of isobornyl methacrylate was changed to 15, and the added amount of acrylonitrile was changed to 55 g.

SYNTHESIS EXAMPLE 6

—Preparation of Hollow Particles F—

The hollow particles F were prepared in the same manner as in Synthesis Example 1, provided that isobornyl methacrylate was replaced with vinylidene chloride.

SYNTHESIS EXAMPLE 7

—Preparation of Hollow Particles G—

The hollow particles G were prepared in the same manner as in Synthesis Example 1, provided that the revolution speed of the homomixer was changed at 3,100 rpm.

SYNTHESIS EXAMPLE 8

—Preparation of Hollow Particles H—

The hollow particles H were prepared in the same manner as in Synthesis Example 1, provided that the mixing and stirring were performed by the homomixer at 12,000 rpm for 30 minutes.

SYNTHESIS EXAMPLE 9

—Preparation of Hollow Particles I—

The hollow particles I were prepared in the same manner as in Synthesis Example 1, provided that the amount of isobutene was changed to 10 g.

SYNTHESIS EXAMPLE 10

—Preparation of Hollow Particles J—

The hollow particles J were prepared in such a manner that the reacted suspension of Synthesis Example 1 was subjected to centrifugal separation by means of a centrifugal separation device at 2000 rpm, for 30 minutes, a small volume of supernatant thereof was removed, and then the remained liquid was filtered to thereby yield the hollow particles J.

The obtained hollow particles A to F were subjected to the measurements of: a glass transition temperature Tg, a void ratio, a maximum particle diameter D100, a ratio D100/D50 of the maximum particle diameter D100 to 50% cumulative particle diameter D50, and a ratio of the particle having a particle diameter of 2 μm or less. The results are presented in Table 1.

<Measurement of Glass Transition Temperature Tg>

A dispersion of hollow particles was coated on an aluminum plate, and dried to thereby form a thin layer. The thus obtained thin layer was subjected to the measurement of logarithmic decrement by means of a rigid-body pendulum type physical properties testing instrument (a product name: RPT 300W, a manufacturer: A&D Company, Ltd.) using a pipe edge, at a temperature increasing rate of 10° C./min. Based on the thus obtained logarithmic decrement, a glass transition temperature was calculated.

<Void Ratio of Hollow Particles>

First of all, a true specific gravity was measured in accordance with an IPA method, and then a void ratio of the hollow particles was obtained based on the true specific gravity.

(1) Pretreatment of Sample

A sample was dried at 60° C. for twenty-four hours as a pretreatment.

(2) Reagent

Isopropyl Alcohol (IPA: first class reagent)

(3) Measuring Method

W1: A measuring flask was precisely weighted.

W2: Approximately 0.5 g of the dried sample was loaded in the measuring flask, and the measuring flask was again weighted.

W3: Approximately 50 mg of IPA were added to the measuring flask, and the measuring flask was sufficiently shaken so as to completely remove the air present outside the hollow particles.

W3: IPA was further added until it reaches a bench mark marked on the measuring flask, and then the measuring flask was weighted.

W4: As a blank sample, a measuring flask was added with IPA until IPA reaches a bench mark marked thereon, and the measuring flask was weighted.

(4) Calculation of True Specific Gravity $$\text{True specific gravity} = \frac{(W2 - W1) \times [(W4 - W1)/100]}{(W4 - W1) - (W3 - W2)}$$

(5) Calculation of Void Ratio $$\text{Void ratio (\%)} = [1 - 1/(1.1/\text{true specific gravity})] \times 100$$

<Maximum Particle Diameter D100, Ratio D100/D50, Ratio of Fine Hollow Particles>

The particle diameter and particle size distribution of the hollow particles, i.e. the maximum particle diameter D100, the ratio D100/D50, and the ratio of the hollow particles having a particle diameter of 2 μm or less, were measured by means of a laser diffraction particle size distribution measuring device (LA-900, manufactured by Horiba, Ltd.).

TABLE 1

| | Tg (° C.) | Void ratio (%) | D100 (μm) | D100/D50 |
|---|---|---|---|---|
| Hollow particles A | 105 | 89 | 10.0 | 2.2 |
| Hollow particles B | 105 | 91 | 9.0 | 2.0 |
| Hollow particles C | 104 | 90 | 9.0 | 2.1 |
| Hollow particles D | 104 | 85 | 9.0 | 2.9 |
| Hollow particles E | 104 | 70 | 9.0 | 2.8 |
| Hollow particles F | 43 | 89 | 10.0 | 3.1 |
| Hollow particles G | 105 | 85 | 11.0 | 2.3 |
| Hollow particles H | 104 | 68 | 4.0 | 2.5 |
| Hollow particles I | 105 | 65 | 8.3 | 2.1 |
| Hollow particles J | 105 | 85 | 9.0 | 1.9 |

Note that, the ratios of hollow particles having a diameter of 2 μm or less in the hollow particles A-F were 7%, 5%, 8%, 10%, 10%, and 14%, respectively.

EXAMPLE 1

—Preparation of Reversible Thermosensitive Recording Medium—

<Preparation of Intermediate Layer>

30 parts of a water dispersion liquid (solids content: 30%) of hollow particles (hollow particles A in Table 1), 28 parts of polyurethane resin emulsion (solids content: 35%, SUPERFLEX 150, manufactured by Dai-Ichi Kogyo Seiyaku Co., Ltd.), 9 parts of completely saponified polyvinyl alcohol (solids content: 16%), and 50 parts of water were mixed. The mixture was stirred and dispersed to thereby obtain a coating liquid of an intermediate layer. The thus obtained coating liquid was coated on a white polyethylene terephthalate (PET) film (manufactured by Teijin Limited) having a thickness of 250 μm by means of a wire bar. The coated layer was dried at 80° C. for 2 minutes to thereby obtain an intermediate layer having a thickness of 30 μm.

<Preparation of Thermosensitive Recording Layer>

3 parts of the developer (melting point of 145° C.) represented by the structure formula below, 9 parts of 50% methyethyl ketone (MEK) solution of acrylic polyol resin (hydroxyl value: 70 mgKOH/g, oxygen value: less than 1.0 mgKOH/g, mass average molecular weight: 35,000, Tg: 52° C., hydroxyl group containing monomer: 2-hydroxyethyl methacrylate), and 70 parts of methylethyl ketone (MEK) were pulverized and dispersed by means of a ball mill so as to obtain particles having an average particle diameter of 1 μm.

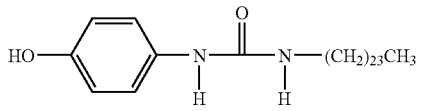

The thus obtained dispersion was added with 1 part of 2-anilino-3-methyl-6-diethylaminofluoran, and 2 parts of 75% ethyl acetate solution of a hexamethylene diisocyanate adduct (a product name: CORONATE® HL, a manufacturer: Nippon Polyurethane Industry Co., Ltd.). The mixture was stirred to thereby prepare a coating liquid of a thermosensitive recording layer. The thus obtained coating liquid was coated on the intermediate layer by means of a wire bar. The coated layer was dried at 100° C. for 3 minutes, and then heated at 60° C. for 24 hours to thereby prepare a thermosensitive recording layer having a thickness of 10 μm.

Sequentially, a coating liquid of a first protective layer having the following composition was coated on the thermosensitive recording layer. The coated layer was dried at 90° C. for 1 minute, and heated at 60° C. for 2 hours to thereby prepare a first protective layer having a thickness of 1 μm.

| Composition of First Protective Layer Coating Liquid | |
|---|---|
| 10% MEK solution of polyester polyol resin (Takelac U, manufactured by Mitsui Chemicals Polyurethanes, Inc.) | 100 parts |
| Zince oxide (manufactured by Sumitomo Osaka Cement Co., Ltd.) | 10 parts |
| CORONATE HL (manufactured by Nippon Polyurethane Industry Co. Ltd.) | 15 parts |

Thereafter, a coating liquid of a second protective layer having the following composition was coated on the first protective layer by means of a wire bar. The coated layer was cured while transferred at 12 m/min. under an ultraviolet lamp having an irradiation energy of 80W/cm to thereby prepare a second protective layer having a thickness of 4 μm. In the manner as described above, a reversible thermosensitive recording medium of Example 1 was prepared.

| Composition of First Protective Layer Coating Liquid | |
|---|---|
| Urethane acrylate containing ultraviolet curing resin (C7-157, manufactured by Dainippon Ink and Chemicals, Inc.) | 7 parts |
| Dipentaerythritol caprolactone modified acrylic ester (KAYARAD DPCA-120, manufactured by Nippon Kayaku Co., Ltd.) | 3 parts |
| Silica (P-527, manufactured by Sumitomo Osaka Cement Co., Ltd.) | 1.5 parts |
| ethyl acetate | 90 parts |

EXAMPLE 2

—Preparation of Reversible Thermosensitive Recording Medium—

A reversible thermosensitive recording medium was prepared in the same manner as in Example 1, provided that the hollow particles A were replaced with the hollow particles B.

EXAMPLE 3

—Preparation of Reversible Thermosensitive Recording Medium—

A reversible thermosensitive recording medium was prepared in the same manner as in Example 1, provided that the hollow particles A were replaced with the hollow particles C.

EXAMPLE 4

—Preparation of Reversible Thermosensitive Recording Medium—

A reversible thermosensitive recording medium was prepared in the same manner as in Example 1, provided that the polyurethane resin emulsion (solids content: 35%, a product name: SUPERFLEX 150, a manufacturer: Dai-Ichi Kogyo Seiyaku Co., Ltd.) used for the coating liquid of the intermediate layer was replaced with acrylic resin emulsion (solids content: 35%, a product name: JOHNCRYL® 538, a manufacturer: Johnson Polymer).

EXAMPLE 5

—Preparation of Reversible Thermosensitive Recording Medium—

A reversible thermosensitive recording medium was prepared in the same manner as in Example 1, provided that an intermediate layer was prepared in the following manner.

30 parts of a water dispersion liquid (solids content: 30%) of hollow particles (hollow particles A in Table 1), 28 parts of polyurethane acrylate ultraviolet curing resin emulsion (solids content: 35%, a product name: BEAMSET EM-90, a manufacturer: Arakawa Chemical Industries, Ltd.), 0.5 parts of DAROCURE 1173 (a manufacturer: Ciba Specialty Chemicals K.K.), 9 parts of completely saponified polyvinyl alcohol (solids content: 16%), and 50 parts of water were mixed. The mixture was stirred and dispersed to thereby obtain a coating liquid of an intermediate layer. The thus obtained coating liquid was coated on a white polyethylene terephthalate (PET) film containing a magnetic layer (a manufacturer: Dainippon Ink and Chemicals, Incorporated), having a thickness of 250 μm by means of a wire bar. The coated layer was dried at 90° C. for 1 minute, and transferred at 9 m/min. under an ultraviolet lamp having an irradiation energy of 80W/cm to thereby obtain an intermediate layer having a thickness of 6 μm.

EXAMPLE 6

—Preparation of Reversible Thermosensitive Recording Medium—

The reversible thermosensitive recording medium was prepared in the same manner as in Example 5, provided that polyurethane acrylate ultraviolet curing resin emulsion (solids content: 35%, a product name: BEAMSET EM-90, a manufacturer: Arakawa Chemical Industries, Ltd.) was replaced with polyurethane acrylate ultraviolet curing resin emulsion (solids content: 35%, a product name: DW7825, a manufacturer: Dicel UCB Company Limited).

EXAMPLE 7

—Preparation of Reversible Thermosensitive Recording Medium—

The reversible thermosensitive recording medium was prepared in the same manner as in Example 1, provided that the hollow particles A were replaced with the hollow particles D.

EXAMPLE 8

—Preparation of Reversible Thermosensitive Recording Medium—

The reversible thermosensitive recording medium was prepared in the same manner as in Example 1, provided that the hollow particles A were replaced with the hollow particles E.

EXAMPLE 9

—Preparation of Reversible Thermosensitive Recording Medium—

The reversible thermosensitive recording medium was prepared in the same manner as in Example 1, provided that the following compound (melting point: 143° C.) was used as a color developer.

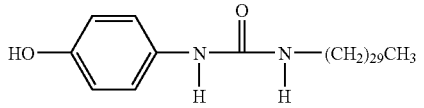

EXAMPLE 10

—Preparation of Reversible Thermosensitive Recording Medium—

The reversible thermosensitive recording medium was prepared in the same manner as in Example 1, provided that the following compound was used as a color developer.

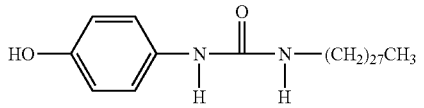

COMPARATIVE EXAMPLE 1

—Preparation of Reversible Thermosensitive Recording Medium—

The reversible thermosensitive recording medium was prepared in the same manner as in Example 1, provided that the hollow particles A were replaced with the hollow particles F.

COMPARATIVE EXAMPLE 2

—Preparation of Reversible Thermosensitive Recording Medium—

The reversible thermosensitive recording medium was prepared in the same manner as in Example 1, provided that the hollow particles A were replaced with Fuji Balloon S35 (an average particle diameter: 40 μm) manufactured by Fuji Silysia Chemical Ltd.

COMPARATIVE EXAMPLE 3

—Preparation of Reversible Thermosensitive Recording Medium—

The reversible thermosensitive recording medium was prepared in the same manner as in Example 1, provided that the hollow particles A were replaced with Microsphere® F-30 (an average particle diameter: 30 μm) manufactured by Matsumoto Yushi-Seiyaku Co., Ltd.

COMPARATIVE EXAMPLE 4

—Preparation of Reversible Thermosensitive Recording Medium—

The reversible thermosensitive recording medium was prepared in the same manner as in Example 1, provided that the hollow particles A were replaced with Ropaque® (void ratio: 50%, an average particle diameter: 1 μm) manufactured by Rohm and Haas Japan K.K.

COMPARATIVE EXAMPLE 5

—Preparation of Reversible Thermosensitive Recording Medium—

The reversible thermosensitive recording medium was prepared in the same manner as in Example 1, provided that the intermediate layer was not disposed.

COMPARATIVE EXAMPLE 6

—Preparation of Reversible Thermosensitive Recording Medium—

The reversible thermosensitive recording medium was prepared in the same manner as in Example 1, provided that the following compound (melting point: 145° C.) as a color developer.

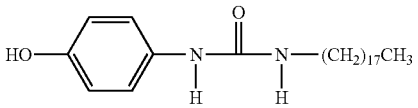

COMPARATIVE EXAMPLE 7

—Preparation of Reversible Thermosensitive Recording Medium—

The reversible thermosensitive recording medium was prepared in the same manner as in Example 1, provided that the following compound (melting point: 140° C.) as a color developer.

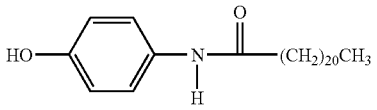

COMPARATIVE EXAMPLE 8

—Preparation of Reversible Thermosensitive Recording Medium—

The reversible thermosensitive recording medium was prepared in the same manner as in Example 1, provided that the following compound (melting point: 141° C.) as a color developer.

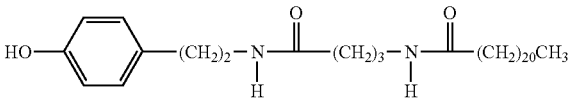

COMPARATIVE EXAMPLE 9

—Preparation of Reversible Thermosensitive Recording Medium—

The reversible thermosensitive recording medium was prepared in the same manner as in Example 1, provided that Hollow particles A were replaced with Hollow particles G.

COMPARATIVE EXAMPLE 10

—Preparation of Reversible Thermosensitive Recording Medium—

The reversible thermosensitive recording medium was prepared in the same manner as in Example 1, provided that Hollow particles A were replaced with Hollow particles H.

COMPARATIVE EXAMPLE 11

—Preparation of Reversible Thermosensitive Recording Medium—

The reversible thermosensitive recording medium was prepared in the same manner as in Example 1, provided that Hollow particles A were replaced with Hollow particles I.

COMPARATIVE EXAMPLE 12

—Preparation of Reversible Thermosensitive Recording Medium—

The reversible thermosensitive recording medium was prepared in the same manner as in Example 1, provided that Hollow particles A were replaced with Hollow particles J.

COMPARATIVE EXAMPLE 13

—Preparation of Reversible Thermosensitive Recording Medium—

The reversible thermosensitive recording medium was prepared in the same manner as in Example 1, provided that the following compound (melting point: 140° C.) as a color developer.

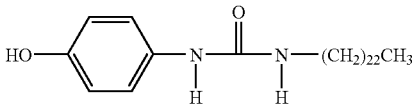

Each reversible thermosensitive recording mediums prepared in Examples 1-10 and Comparative Examples 1-13 were evaluated their properties according to the following manner. The results are shown in Table 4.

<Image Density, Background Density, Remains from Erasure>

Printing and erasure were performed on the above-prepared reversible thermosensitive recording medium by using a thermal printing simulator which uses a true edge type thermal head KSB320AA (value of resistance: 1206Ω) manufactured by Kyocera Corporation, and a ceramic heater (width: 4 mm) at the conditions below.

Conditions for the evaluation are a printing speed of 5 inch/s, and a vertical scanning density of 8 dot/mm.

Image density is the maximum density when printing is performed while varying a voltage of the applied energy by 1V.

Erasure density is the minimum erasure density when erasing a solid image formed by the applied energy which obtained the maximum density in the image density while varying the setting temperature of the ceramic heater by 5° C.

<Dusts Adhesion>

—Image Density—

The identical pattern was repeatedly printed and erased 200 continuous times by means of the above-mentioned thermal printing simulator at the applied energy which obtained the maximum density and the set temperature of the ceramic temperature which obtained the minimum erasure density, and the image density of the resulted image was measured by means of a Macbeth densitometer RD-914.

—Printing Friction Mark—

A color unevenness of the solid image in the sample used for the above-mentioned image density was evaluated in accordance with the ranks presented in Table 2.

—Printing Dusts Adhesion—

The solid image printed on the sample used in the evaluation of "Image Density" was erased, and the condition of the area where the image was erased was evaluated in terms of deposits, in accordance with the ranks presented in Table 3.

TABLE 2

| Rank | Condition | Visual image of solid image |
|---|---|---|
| A | Entirely uniform | 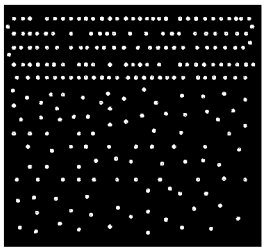 |

TABLE 2-continued

| Rank | Condition | Visual image of solid image |
|---|---|---|
| B | Partially uneven in the direction of scanning in the solid image | 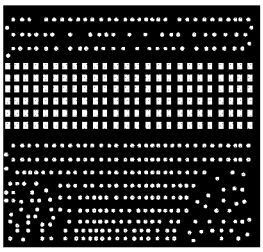 |
| C | Significantly uneven at a part of the print | 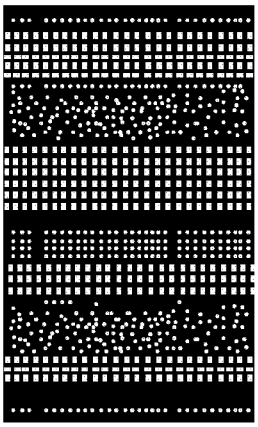 |

TABLE 3

| Rank | Condition | Visual image of erased area |
|---|---|---|
| A | Entirely clean | 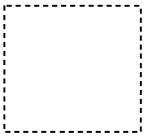 |
| B | Brown deposits are partially present in the area, or the area is slightly colored in brown | 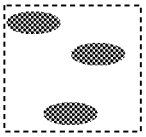 |
| C | Brown deposits are present in the whole area | 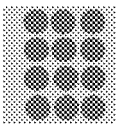 |

TABLE 4

| | Erasing ability | | | | | Dusts adhesion | | |
|---|---|---|---|---|---|---|---|---|
| | Image density | Background density | Erasing temperature (° C.) | Erasing density | Erasure remains | Image density | Friction mark | Dust adhesion |
| Ex. 1 | 1.46 | 0.08 | 110 | 0.14 | 0.06 | 1.35 | A | A |
| Ex. 2 | 1.43 | 0.08 | 110 | 0.14 | 0.06 | 1.30 | A | A |
| Ex. 3 | 1.47 | 0.08 | 110 | 0.14 | 0.06 | 1.33 | A | A |
| Ex. 4 | 1.44 | 0.08 | 110 | 0.14 | 0.06 | 1.31 | A | A |
| Ex. 5 | 1.43 | 0.08 | 110 | 0.14 | 0.06 | 1.32 | A | A |
| Ex. 6 | 1.42 | 0.08 | 110 | 0.14 | 0.06 | 1.32 | A | A |
| Ex. 7 | 1.40 | 0.08 | 110 | 0.14 | 0.06 | 1.32 | A | A |
| Ex. 8 | 1.42 | 0.08 | 115 | 0.15 | 0.07 | 1.30 | A | A |
| Ex. 9 | 1.45 | 0.08 | 110 | 0.12 | 0.04 | 1.35 | A | A |
| Ex. 10 | 1.43 | 0.08 | 110 | 0.14 | 0.06 | 1.34 | A | A |
| Com. Ex. 1 | 1.29 | 0.08 | 120 | 0.15 | 0.07 | 1.17 | A | A |
| Com. Ex. 2 | 1.31 | 0.08 | 125 | 0.16 | 0.08 | 0.98 | C | C |
| Com. Ex. 3 | 1.34 | 0.08 | 125 | 0.17 | 0.09 | 0.83 | C | C |
| Com. Ex. 4 | 1.46 | 0.08 | 125 | 0.17 | 0.09 | 1.04 | B | A |
| Com. Ex. 5 | 1.45 | 0.08 | 140 | 0.23 | 0.15 | 1.16 | C | C |
| Com. Ex. 6 | 1.48 | 0.08 | 110 | 0.20 | 0.12 | 1.35 | A | B |
| Com. Ex. 7 | 1.48 | 0.09 | 105 | 0.68 | 0.59 | 1.38 | A | C |
| Com. Ex. 8 | 0.90 | 0.08 | 105 | 0.51 | 0.43 | 0.84 | A | C |
| Com. Ex. 9 | 1.32 | 0.08 | 110 | 0.14 | 0.06 | 1.20 | A | A |
| Com. Ex. 10 | 1.45 | 0.08 | 110 | 18 | 0.10 | 1.31 | A | A |
| Com. Ex. 11 | 1.42 | 0.08 | 110 | 0.18 | 0.10 | 1.30 | A | A |
| Com. Ex. 12 | 1.46 | 0.08 | 110 | 0.14 | 0.06 | 1.34 | A | A |
| Com. Ex. 13 | 1.48 | 0.08 | 110 | 0.19 | 0.10 | 1.39 | A | A |

In Comparative Example 9, the obtained image had roughness in the shape thereof, and did not have fine-line-reproduction ability, i.e., the formed line by one-dot printing was not continuous.

What is claimed is:

1. A reversible thermosensitive recording medium comprising:

a support;

an intermediate layer; and a thermosensitive recording layer which reversibly changes a color thereof depending on a temperature, wherein the thermosensitive recording layer comprises an electron-donating coloring compound, and an electron-accepting compound represented by the following general formula 1:

General formula 1

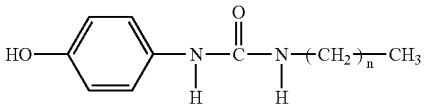

where, n is an integer of 23 or more, wherein the intermediate layer is disposed between the support and the thermosensitive recording layer, and comprises hollow particles having a void ratio of 70% or more, a maximum diameter D100 of 5.0 μm to 10.0 μm, and a ratio D100/D50 of 2.0 to 3.0, where the ratio D100/D50 is a ratio of the maximum diameter D100 to a 50% cumulative particle diameter D50 of the hollow particles.

2. The reversible thermosensitive recording medium according to claim 1, wherein n is an integer in the range of 27 to 32.

3. The reversible thermosensitive recording medium according to claim 1, wherein a ratio of the hollow particles having a diameter of 2 μm or less is 5% to 10% with respect to the total hollow particles.

4. The reversible thermosensitive recording medium according to claim 1, wherein the hollow particles are formed of vinyl polymer having a crosslinking structure.

5. A reversible thermosensitive recording label comprising:

a reversible thermosensitive recording medium, which comprises: a support; an intermediate layer; a thermosensitive recording layer which reversibly changes a color thereof depending on a temperature; and either an adhesive layer or a tacky layer disposed on a face of the reversible thermosensitive recording medium opposite to a face thereof on which an image is formed, wherein the thermosensitive recording layer comprises an electron-donating coloring compound, and an electron-accepting compound represented by the following general formula 1:

General formula 1

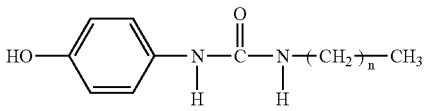

where, n is an integer of 23 or more, wherein the intermediate layer is disposed between the support and the thermosensitive recording layer, and comprises hollow particles having a void ratio of 70% or more, a maximum diameter D100 of 5.0 μm to 10.0 μm, and a ratio D100/D50 of 2.0 to 3.0, where the ratio D100/D50 is a ratio of the maximum diameter D100 to a 50% cumulative particle diameter D50 of the hollow particles.

6. A reversible thermosensitive recording member comprising:

an information-memorizing part; and a reversible display part, wherein the reversible display part comprises:

a support;

an intermediate layer; and a thermosensitive recording layer which reversibly changes a color thereof depending on a temperature, wherein the thermosensitive recording layer comprises an electron-donating coloring compound, and an electron-accepting compound represented by the following general formula 1:

General formula 1

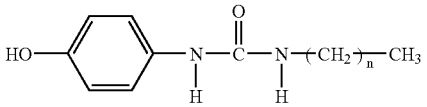

where, n is an integer of 23 or more, wherein the intermediate layer is disposed between the support and the thermosensitive recording layer, and comprises hollow particles having a void ratio of 70% or more, a maximum diameter D100 of 5.0 μm to 10.0 μm, and a ratio D100/D50 of 2.0 to 3.0, where the ratio D100/D50 is a ratio of the maximum diameter D100 to a 50% cumulative particle diameter D50 of the hollow particles.

7. The reversible thermosensitive recording member according to claim 6, wherein the information-memorizing part is selected from a card, a disk, a disk cartridge, and a tape cassette.

8. An image-processing apparatus comprising:

a reversible thermosensitive recording medium housed therein; and at lest one of an image-forming unit configured to heat the reversible thermosensitive recording medium so as to form an image on the reversible thermosensitive recording medium; and an image-erasing unit configured to heat so as to erase the image formed on the reversible thermosensitive recording medium, wherein the reversible thermosensitive recording medium comprises:

a support;

an intermediate layer; and a thermosensitive recording layer which reversibly changes a color thereof depending on a temperature, wherein the thermosensitive recording layer comprises an electron-donating coloring compound, and an electron-accepting compound represented by the following general formula 1:

General formula 1

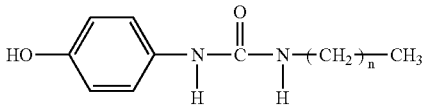

where, n is an integer of 23 or more, wherein the intermediate layer is disposed between the support and the thermosensitive recording layer, and comprises hollow particles having a void ratio of 70% or more, a maximum diameter D100 of 5.0 μm to 10.0 μm, and a ratio D100/D50 of 2.0 to 3.0, where the ratio D100/D50 is a ratio of the maximum diameter D100 to a 50% cumulative particle diameter D50 of the hollow particles.

9. The image-processing apparatus according to claim 8, wherein the image-forming unit is a thermal head.

10. The image-processing apparatus according to claim 8, wherein the image-erasing unit is either a thermal head or a ceramic heater.

11. An image-processing method comprising at least one of:

heating a reversible thermosensitive recording medium so as to form an image thereon; and heating the reversible thermosensitive recording medium so as to erase the image formed thereon, wherein the reversible thermosensitive recording medium comprises:

a support;

an intermediate layer; and a thermosensitive recording layer which reversibly changes a color thereof depending on a temperature, wherein the thermosensitive recording layer comprises an electron-donating coloring compound, and an electron-accepting compound represented by the following general formula 1:

General formula 1

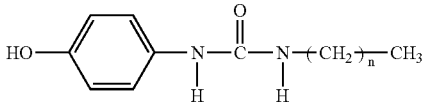

where, n is an integer of 23 or more, wherein the intermediate layer is disposed between the support and the thermosensitive recording layer, and comprises hollow particles having a void ratio of 70% or more, a maximum diameter D100 of 5.0 μm to 10.0 μm, and a ratio D100/D50 of 2.0 to 3.0, where the ratio D100/D50 is a ratio of the maximum diameter D100 to a 50% cumulative particle diameter D50 of the hollow particles.

12. The image-processing method according claim 11, wherein the heating for the image formation is performed by means of a thermal head.

13. The image-processing method according to claim 11, wherein the heating for the image erasure is performed by means of either a thermal head or a ceramic heater.

* * * * *